US008000641B2

(12) United States Patent
Yamada et al.

(10) Patent No.: US 8,000,641 B2
(45) Date of Patent: Aug. 16, 2011

(54) IMAGE FORMING APPARATUS FOR ELECTROPHOTOGRAPHIC IMAGING

(75) Inventors: Taichi Yamada, Kanagawa (JP); Yosuke Tsurumi, Kanagawa (JP); Akira Matsumoto, Kanagawa (JP); Fusako Kiyono, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 489 days.

(21) Appl. No.: 12/100,055

(22) Filed: Apr. 9, 2008

(65) Prior Publication Data

US 2009/0067894 A1 Mar. 12, 2009

(30) Foreign Application Priority Data

Sep. 12, 2007 (JP) ..... 2007-236544

(51) Int. Cl.
*G03G 9/10* (2006.01)
*G03G 15/01* (2006.01)

(52) U.S. Cl. ..... 399/302

(58) Field of Classification Search ..... 399/302, 399/308, 296

See application file for complete search history.

(56) References Cited

U.S. PATENT DOCUMENTS

| | | | | |
|---|---|---|---|---|
| 5,119,140 | A | 6/1992 | Berkes et al. | |
| 6,096,466 | A * | 8/2000 | Imai et al. | 430/123.58 |
| 6,124,067 | A * | 9/2000 | Mikuriya et al. | 430/100 |
| 2007/0172748 | A1 | 7/2007 | Inoue et al. | |

FOREIGN PATENT DOCUMENTS

| | | |
|---|---|---|
| JP | A-3-145655 | 6/1991 |
| JP | A-5-210315 | 8/1993 |
| JP | A-2005-099072 | 4/2005 |
| JP | A-2005-115200 | 4/2005 |
| JP | A-2006-038961 | 2/2006 |
| JP | A-2006-330022 | 12/2006 |
| JP | A-2007-199267 | 8/2007 |

* cited by examiner

*Primary Examiner* — Quana M Grainger
(74) *Attorney, Agent, or Firm* — Oliff & Berridge PLC

(57) ABSTRACT

The present invention provides an image forming apparatus comprising at least an image holding member, an charging unit, a latent image forming unit, a developing unit, an intermediate transfer belt, a primary transfer unit, a secondary transfer unit, a fixing unit, and a cleaning unit, wherein a surface hardness of a side, of the intermediate transfer belt, contacting with the image holding member being 10 to 30, a carrier in the developer having at least two resin-coated layers on a surface of a core material containing ferrite, and the core material having a surface roughness Sm of 2.0 μm or less, a surface roughness Ra of 0.1 μm or more, and an average a circularity degree of 0.975 to 1.000.

20 Claims, 6 Drawing Sheets

IMAGE FORMING APPARATUS FOR ELECTROPHOTOGRAPHIC IMAGING

CROSS-REFERENCE TO RELATED APPLICATIONS

This application is based on and claims priority under 35 USC 119 from Japanese Patent Application No. 2007-236544 filed on Sep. 12, 2007.

BACKGROUND

1. Technical Field

The present invention relates to an image forming apparatus.

2. Related Art

Electrophotography is generally a method of forming a fixed image via plural steps of electrically forming a latent image on a surface of a photoreceptor (image holding member) utilizing photoconductive substances by a variety of units, developing the formed latent image using a developer containing a toner to form a toner image, transferring the toner image on the photoreceptor surface onto a surface of a transfer receiving body such as a paper via or not via an intermediate transfer body, and fixing this transferred image by pressurizing or heat pressurizing or a solvent steam. A residual toner remaining on the photoreceptor surface untransferred is removed from the photoreceptor surface using a cleaning blade.

SUMMARY

According to an aspect of the present invention, there is provided an image forming apparatus comprising at least an image holding member; a charging unit for charging the image holding member; a latent image forming unit for forming a latent image on a surface of the charged image holding member; a developing unit for developing the latent image formed on the surface of the image holding member with a developer containing at least a toner and a carrier to form a toner image; an intermediate transfer belt which contacts the image holding member and to which the toner image formed on the surface of the image holding member is primarily transferred; a primary transfer unit for primarily transferring the toner image formed on the surface of the image holding member onto the intermediate transfer belt by generating an electric field; a secondary transfer unit for secondarily transferring the toner image which has been primarily transferred onto the intermediate transfer belt, onto a transfer receiving body; a fixing unit for fixing the toner image which has been transferred onto the transfer receiving body; and a cleaning unit for removing residual toner on the surface of the image holding member after transfer, a surface hardness of a side, of the intermediate transfer belt, contacting with the image holding member being 10 to 30, the carrier having at least two resin-coated layers on a surface of a core material containing ferrite, and the core material having a surface roughness Sm (average interval of irregularities) of 2.0 μm or less, a surface roughness Ra (arithmetic average roughness) of 0.1 μm or more, and an average circularity degree of 0.975 to 1.000.

BRIEF DESCRIPTION OF THE DRAWINGS

Exemplary embodiments of the present invention will be described in detail based on the following figures, wherein.

DETAILED DESCRIPTION

The image forming apparatus of the present invention will be explained in detail below referring to drawings.

First Exemplary Embodiment

Figure 1:
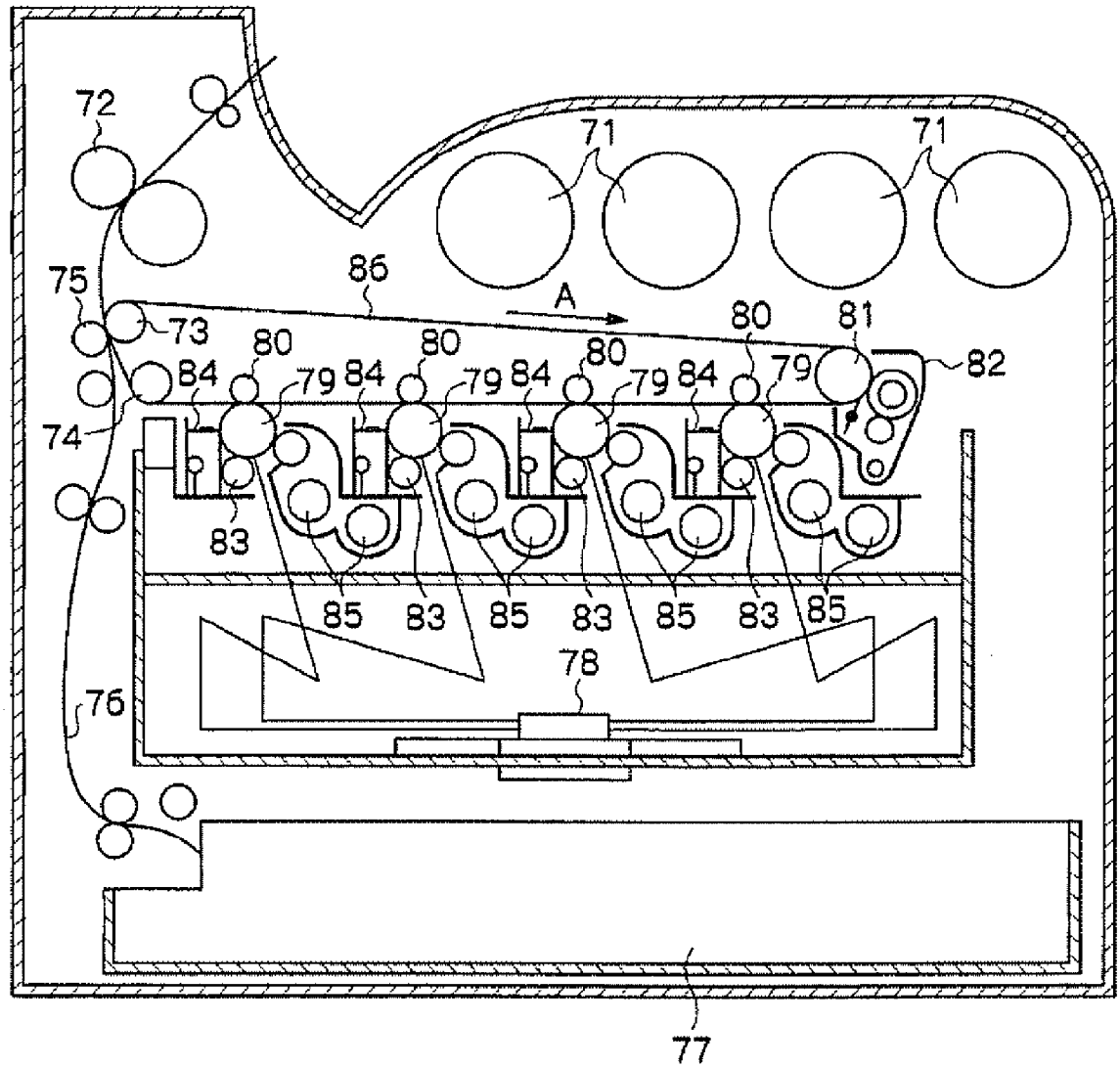
FIG. 1 is a schematic construction view showing the image forming apparatus of the invention of a first exemplary embodiment.

FIG. 1 is a schematic construction view showing the image forming apparatus of the invention of a first exemplary embodiment. The present exemplary embodiment is constructed as an image forming apparatus in an intermediate transferring manner comprising an intermediate transferring belt.

Specifically, the apparatus comprises a photoreceptor (image holding member) 79, a charging roll 83 (charging unit) for charging the photoreceptor 79, a laser generating apparatus 78 (latent image forming unit) for exposing a surface of the photoreceptor 79 to light to form a latent image, a developing equipment 85 (developing unit) for developing the latent image formed on a surface of the photoreceptor 79 using a developer to form a toner image, an intermediate transferring belt 86 which is contacted with the photoreceptor 79 and onto which the toner image formed on a surface of the photoreceptor 79 is primarily transferred, a primary transferring roll (primary transfer unit) 80 for primarily transferring the toner image formed on a surface of the photoreceptor 79 onto the intermediate transfer belt 86 by generating an electric field, a secondary transferring roll (secondary transfer unit) 75 for secondarily transferring the toner image which has been primarily transferred onto the intermediate transfer belt 86, onto a recording paper (transfer receiving body), a photoreceptor cleaner (cleaning unit) 84 for removing a residual toner and a trash adhered to the photoreceptor 79, and a fixing roller (fixing unit) 72 for fixing the toner image on the recording paper (transfer receiving body).

Further, a construction of the image forming apparatus shown in FIG. 1 will be explained in detail. The image forming apparatus shown in FIG. 1 comprises, as a main constitutional member, four toner cartridges 71, one pair of fixing rolls (fixing unit) 72, a back-up roll 73, a tension roll 74, a secondary transferring roll 75, a paper passageway 76, a recording medium accommodating part 77, a laser generating apparatus 78, four photoreceptors 79, four primary transferring rolls 80, a driving roll 81, a transference cleaner 82, four charging rolls 83, a photoreceptor cleaner 84, a developing equipment 85, and an intermediate transfer belt 86.

First, at a periphery of the photoreceptor 79, the charging roll 83, the developing equipment 85, the primary transferring roll 80 disposed via the intermediate transfer belt 86, and the photoreceptor cleaner 84 are arranged counterclockwise, and one set of these members forms a developing unit corresponding to one color. In addition, a toner cartridge 71 for supplying a developer to the developing equipment 85 is provided for each developing unit, and a laser generating apparatus 78 which can irradiate a surface of the photoreceptor 79 between the charging roll 83 and the developing equipment 85 with laser light corresponding to image information is provided with respect to the photoreceptor 79 of each developing unit.

Four developing units corresponding to four colors (e.g. cyan, magenta, yellow, black) are arranged in series in the image forming apparatus, and the intermediate transfer belt 86 is provided so as to pass through a contact part between the photoreceptor 79 and the primary transferring roll 80 of four developing units. The intermediate transfer belt 86 is stretched with the back-up roll 73, the tension roll 74 and the driving roll 81 which are provided counterclockwise in this order on its inner circumferential side. The transference cleaner 82 for cleaning an outer circumferential surface of the intermediate transfer belt 86 is provided so as to pressure-contact with the driving roll 81 via the intermediate transfer belt 86 on a side opposite to the driving roll 81.

The secondary transferring roll 75 for transferring a toner image formed on an outer circumferential surface of the intermediate transfer belt 86 is provided on a surface of a recording paper which is conveyed from the recording medium accommodating part 77 via the paper passageway 76 on a side opposite to the back-up roll 73 via the intermediate transfer belt 86, so that it is contacted with the back-up roll 73 with pressure.

The recording medium accommodating part 77 for storing a recording paper is provided on a bottom of the image forming apparatus, and may supply the paper from the recording medium accommodating part 77 via a paper passageway 76 so as to pass through a pressure contact part between the back-up roll 73 and the secondary transferring roll 75 which constitute a secondary transferring part. The recording paper which has passed through this pressure contact part may be further conveyed with a not shown conveying unit so as to pass through a pressure contact part of one pair of fixing rolls 72 and, finally, may be discharged to the outside of the image forming apparatus.

A surface hardness of a side contacting with the photoreceptor 79 of the intermediate transfer belt 86 is 10 to 30. When the surface hardness is less than 10, since the surface hardness is usually higher than a hardness of an interior of the intermediate transfer belt, adhesiveness with the interior is deteriorated and deterioration such as peeling of a surface is easily generated. On the other hand, when the surface hardness is more than 30, a cracked species of a carrier becomes easy to be stuck into a surface of the photoreceptor.

In the invention, the "surface hardness" refers to a durometer hardness according to JIS K7215 (1986).

It is preferable that the intermediate transfer belt 86 contains a polyimide resin or a polyamideimide resin because a strength of a belt itself is high, and durability may be satisfied. A surface resistivity of the intermediate transfer belt 86 is preferably in a range of $1\times10^{9}\Omega/\square$ to $1\times10^{4}\Omega/\square$. In order to control the surface resistivity, the intermediate transfer belt 86 contains an electrically conductive filler as necessary. As the electrically conductive filler, carbon black, graphite, an metal or an alloy such as aluminum and a copper alloy, a metal oxide such as tin oxide, zinc oxide, potassium titanate, and tin oxide-indium oxide or tin oxide-antimony oxide composite oxide, or an electrically conductive polymer such as polyaniline is used alone or in combination of two or more kinds. Among them, as the electrically conductive filler, carbon black is suitable from a viewpoint of the cost. If necessary, a processing assistant such as a dispersant and a lubricant may be added.

In the image forming apparatus of the exemplary embodiment, a developer containing at least a carrier in which a surface of a core material containing ferrite has at least two resin-covered layers, and the core material has a surface roughness Sm (average interval of irregularities) of 2.0 μm or less, a surface roughness Ra (arithmetic average roughness) of 0.1 μm or more, and an average circularity degree of 0.975 to 1.000, and a toner (so-called two-component developer) is used. The developer used in the exemplary embodiment will be explained below.

(Core Material)

The core material has a surface roughness Sm (average interval of irregularities) of 2.0 μm or less, a surface roughness Ra (arithmetic average roughness) of 0.1 μm or more, and an average circularity degree of 0.975 to 1.000.

By adopting the core material in the carrier of the exemplary embodiment having a surface roughness Sm of 2.0 μm or less, and a surface roughness Ra of 0.1 μm or more, when a resin-covered layer is covered as described later, adhesiveness between the core material and an adjacent resin-covered layer is improved due to the anchoring effect of a resin which is a main component of the resin-covered layer, on the core material. In addition, by adopting a circularity degree of the core material of 0.975 to 1.000, a cracked species of the carrier becomes difficult to be generated and, even when the species is generated, generation of a sharp cracked species may be suppressed to some extent.

A magnetic core material is formed by granulation and sintering, and the core material in the carrier of the exemplary embodiment is preferably ground fine. A grinding method is not particularly limited, but the coring material may be ground according to the known grinding method, and examples include a mortar, a ball mill, and a jet mill. The final ground state at pre-treatment is different depending on material quality, and it is preferable that an average particle diameter is around 2 μm to 10 μm. When the diameter is less than 2 μm, a desired particle diameter may not be obtained in some cases and, when the particle diameter is more than 10 μm, a particle diameter becomes too great, or a circularity degree is reduced in some cases.

A sintering temperature is preferably suppressed lower than the previous case, and specifically, a sintering temperature is different depending on a material used, and is suitably around 500° C. or higher and 1200° C. or lower, more suitably 600° C. or higher and 1000° C. or lower. When the sintering temperature is lower than 500° C., a necessary magnetic force as the carrier is not obtained and, when the sintering temperature is higher than 1200° C., crystal growth is rapid, unevenness of an interior structure is easily caused, and a crack or a fissure is easily generated.

In order to suppress the sintering temperature low, it is preferable to perform provisional sintering stepwise in a sintering step. For this reason, it is preferable that a time necessary for total sintering is longer.

By suppressing the sintering temperature low, and performing provisional sintering stepwise like this, a surface roughness Ra (arithmetic roughness) of the magnetic core may be rough as being 0.1 μm or more, and a surface roughness Sm (average interval of irregularities) may be rendered 2.0 μm or less.

It is necessary that the core material has a surface roughness Ra (arithmetic average roughness) of 0.1 μm or more, and the surface roughness Ra is preferably 0.2 μm or more, particularly preferably 0.3 μm or more. The surface roughness Ra is preferably 0.5 μm or less.

On the other hand, it is necessary that the core material has a surface roughness Sm (average interval of irregularities) of 2.0 μm or less, and the surface roughness Sm is preferably 1.8 μm or less, particularly preferably 1.6 μm or less. And, the surface roughness Sm is preferably 0.5 μm or more.

A specific method of measuring a surface roughness Ra (arithmetic average roughness) and a surface roughness Sm (average interval of irregularities) is a method of obtaining a roughness by observing a surface at magnification of 3000 using a superdepth color 3D shape measuring microscope (VK-9500 manufactured by KEYENCE CORPORATION.) for 50 carriers.

Ra (arithmetic average roughness) is obtained by obtaining a roughness curve from a three-dimensional shape of the observed core surface, summing a measured value of the roughness curve and an absolute value of a deviation to an average line, and averaging this. A standard length upon acquisition of Ra (arithmetic average roughness) is 10 μm, and a cut-off value is 0.08 mm.

Sm (average interval of irregularities) is obtained by obtaining a roughness curve, and obtaining an average value of an interval of a crest root one cycle obtained from an intersection where the roughness curve is crossed with an average line. A standard length when Sm (average interval of irregularities) is obtained is 10 μm, and a cut-off value is 0.08 mm.

These surface roughness Ra (arithmetic average roughness) and surface roughness Sm (average interval of irregularities) are measured according to JIS B 0601 (1994) revision.

An average circularity degree of the core material is required to be 0.975 to 1.000, and is preferably 0.980 to 1.000, further preferably 0.985 to 1.000.

For measuring an average circularity degree, for example, FPIA-3000 (manufactured by Sysmex Corporation) is used. In the apparatus, a manner of measuring particles dispersed in water by a flow-type image analyzing method is adopted, and a sucked particle suspension is introduced into a flat sheath flow cell, and formed into a flat sample stream by a sheath liquid. By irradiating the sample stream with stroboscopic light, a particle during passage is picked up as a stationary image with a CCD) camera through an objective lens, the picked up particle image is subjected to two-dimensional image processing, and a circle equivalent diameter and a circularity degree are calculated from a projected area and a peripheral length. As for the circle equivalent diameter, a diameter of a circle having the same area is calculated as a circle equivalent diameter from an area of the two-dimensional image, for the photographed each particle. At least 5,000 or more of such the photographed particles are image-analyzed, respectively, and a circularity degree of the photographed each particle is obtained by the following equation. In addition, 5,000 or more of the photographed particles are image-analyzed, and statistically processed to obtain an average circularity degree.

$$\text{Circularity degree}=\text{circle equivalent diameter peripheral length/peripheral length}=[2\times(A\pi)^{1/2}]/PM$$

In the equation, A represents a projected area, and PM represents a peripheral length. It is preferable that, in measurement, a LPF mode is used, and a circularity degree is obtained by analysis by removing an image in which particles and core materials having a particle diameter of less than 10 μm or more than 50 μm are not dispersed, and an image of an aggregate of plural them is picked up.

Preparation of a measurement sample is performed, for example, as follows. That is, 0.03 g of the core material is added to an aqueous ethylene glycol solution having a concentration of 25 wt %, this is stirred and dispersed to prepare a dispersion of the core material, and this core material dispersion may be used as the measurement sample.

In order to render an average circularity degree of the core material 0.975 to 1.000, there are, for example, a method of appropriately increasing a particle size distribution at the time of grinding, and a method of making a shape distribution uniform to some extent, in addition to a method of grinding the material finely as described above, and a method of controlling a sintering temperature to be lower than the temperature in conventional cases, and a combination of these methods may be used.

The core material contains ferrite. The ferrite is not particularly limited, the mixture with a metal such as Mn, Ca, Li, Mg, Cu, Zn and Sr is preferable. Particularly preferable examples include Mn—Mg ferrite, and Li—Mn ferrite. These are preferable since a strength of the core, crystal growth, and surface irregularities are easily balanced in a sintering step.

A volume average particle diameter of the core material is preferably 10 μm to 500 μm, more preferably 30 μm to 150 μm, further preferably 30 μm to 100 μm. If the volume average particle diameter of the core material is less than 10 μm, when the core material is used in the developer, an adhering force between the toner and the carrier becomes higher, and a development amount of the toner is decreased in some cases. On the other hand, if the diameter is more than 500 μm, a magnetic brush becomes coarse, and it becomes difficult to form a fine image in some cases. The volume average particle diameter of the core material refers to a value measured using a laser diffraction/scattering-type particle size distribution measuring apparatus (LS Particle Size Analyzer: trade name LS13 320, manufactured by BECKMAN COULTER). For a divided particle size range (channel) in the resulting particle size distribution, a volume accumulation distribution is subtracted from a small particle diameter side, and a particle diameter at accumulation 50% is adopted as a volume average particle diameter $D_{50v}$.

(Resin-Coated Layer)

The carrier of the exemplary embodiment has at least two resin-coated layers on a surface of the core material. It is preferable that a difference between an acid value of a resin which is a main component of each of the resin-coated layers and an acid value of a resin which is a main component of a resin-coated layer adjacent to the resin-coated layer is 0.2 mgKOH/g to 8.0 mgKOH/g as expressed by an absolute value. The "which is a main component of a resin-coated layer" means that a content in the resin-coated layer is 80% by mass or more (preferably 90% by mass or more).

By possession of two resin-coated layers as described above, since the function may be separated into each of resin-coated layers, a high functional carrier may be manufactured, and other resin-coated layer may be further possessed in addition to the two resin-coated layers. However, adhesiveness between respective resin-coated layers where resins having different functions are overlapped is low in may cases. Thereupon, by rendering a difference between an acid value of a resin which is a main component of each of the resin-coated layers and an acid value of a resin which is a main component of an adjacent resin-coated layer in a range of 0.2 mgKOH/g to 8.0 mgKOH/g as expressed by an absolute value, wettability between resins is improved, and electrostatic partial repulsion becomes small, thus, a carrier in which adhesiveness with the adjacent resin-coated layer is improved and, at the same time, unevenness of an electrostatic charge is small, suppression of peeling between layers, and the charging performance are better, particularly, long term image stability under high temperature and high humidity is excellent, and fastness is excellent, can be manufactured. In addition, even when a crack is generated in the carrier, peeling of a further resin layer due to the cracking may be prevented. A difference between an acid value of a resin which is a main component of each of the resin-coated layers and an acid value of a resin which is a main component of the adjacent resin-coated layer is preferably 0.5 mgKOH/g to 8.0 mgKOH/g as expressed by an absolute value, more preferably 0.5 mgKOH/g to 5.0 mgKOH/g as expressed by an absolute value.

Herein, the acid value of a resin which is a main component of the resin-coated layer refers to the mg number of potassium hydroxide necessary for neutralizing a free fatty acid and a resin acid contained in 1 g of a sample, and may be obtained by the following method.

An ethyl ether-ethyl alcohol mixed solution (ethyl ether: ethyl alcohol=2:1, molar ratio) or a benzene-ethyl alcohol mixed solution (benzene ethyl alcohol=2:1, molar ratio) is prepared. The ethyl ether-ethyl alcohol mixed solution or the benzene-ethyl alcohol mixed solution is neutralized with a 0.1 mol/liter solution of potassium hydroxide in ethyl alcohol using phenolphthalein as an indicator in advance immediately before use. And, a 0.1 mol/liter solution of potassium hydroxide in ethyl alcohol is prepared.

For measuring an acid value of the resin, 1 to 20 g of the sample (resin) is exactly weighed, 100 ml of the ethyl ether-ethyl alcohol mixed solution or the benzene-ethyl alcohol mixed solution, and a few droplets of a phenolphthalein solution as an indicator are added thereto, and the mixture is sufficiently shaken until the sample is dissolved.

After the sample is dissolved, the solution is titrated with the alcoholic potassium hydroxide solution and, when pale pink of the indicator continues for 30 seconds, this is adopted as an endpoint of neutralization, and the acid value (AV) is obtained from a use amount thereupon by the following equation.

AV: acid value (mgKOH/g), B: use amount (ml) of 0.1 mol/liter sodium hydroxide ethyl alcohol solution, M: mass (a) of sample $$AV=(B\times 5.61)\div M$$

The carrier of the present exemplary embodiment is preferably such that the acid value of a resin which is a main component of an outermost resin-coated layer among the resin-coated layers is 0.1 mgKOH/g to 25 mgKOH/g. When the acid value of a resin which is a main component of the outermost resin-coated layer is 0.1 mgKOH/g to 25 mgKOH/g, the charging performance becomes better. The acid value of a resin which is a main component of the outermost resin-coated layer is preferably 0.1 mgKOH/g to 15.0 mgKOH/g, further preferably 0.1 mgKOH/g to 10.0 mgKOH/g.

The carrier of the exemplary embodiment is preferably such that a difference (ΔSP) between a solubility parameter of a resin which is a main component of each of the resin-coated layers and a solubility parameter of a resin which is a main component of a resin coated layer adjacent to the resin-coated layer is 0.1 to 2.0 as expressed by an absolute value. When the difference is in this range, affinity between adjacent resin-coated layers is increased, being preferable. The ΔSP is further preferably 0.2 to 1.6. When the ΔSP is less than 0.1, dip with a solvent, mixing of interlayer resins, and localization of added fine particles are caused particularly upon two layered coating using a solvent. When the ΔSP is more than 2.0, affinity between adjacent resin-coated layers is reduced in some cases.

In the invention, the SP value (solubility parameter) means a value obtained by the method of Fedors. The SP value in this case is defined by the following equation (A).

$$SP=\sqrt{\frac{\Delta E}{V}}=\sqrt{\frac{\sum_i \Delta ei}{\sum_i \Delta vi}} \qquad \text{Equation (A)}$$

In the equation (A), SP represents a solubility parameter, ΔE represents a cohesive energy (cal/mol), V represents a molar volume ($cm^3$/mol), Δei represents an evaporation energy of an $i^{th}$ atom or atomic croup (cal/atom or atomic group), Δvi represents a molar volume of an $i^{th}$ atom or atomic group)($cm^3$/atom or atomic group), and i represents an integer of 1 or more.

The SP value represented by the equation (A) is conventionally obtained so that its unit becomes $cal^{1/2}/cm^{3/2}$, and is expressed dimensionlessly. In addition, since a relative difference of the SP value between two compounds has meaningfulness in the exemplary embodiment, a value obtained according to the convention described above is used, and the value is expressed dimensionlessly in the exemplary embodiment.

For a reference, when the SP value represented by the equation (A) is converted into a SI unit ($J^{1/2}/m^{3/2}$), 2046 may be multiplied.

The resin which is a main component of each of the resin-coated layers is not particularly limited as far as the already described definition of the acid value is satisfied, and examples include a polyolefin-based resin such as polyethylene, polypropylene etc.; polyvinyl and polyvinylidene-based resins such as polystyrene, acryl resin, polyacrylonitrile, polyvinyl acetate, polyvinyl alcohol, polyvinyl butyral, polyvinyl chloride, polyvinyl carbazole, polyvinyl ether, polyvinyl ketone etc.; a vinyl chloride-vinyl acetate copolymer; a styrene-acrylic acid copolymer; a straight silicone resin consisting of an organosiloxane bond, or a modified resin thereof; a fluorine resin such as polytetrafluoroethylene, polyvinyl fluoride, polyvinylidene fluoride, polychlorotrifluoroethylene etc.; polyester; polyurethane; polycarbonate; a phenol resin, an amino resin such as a urea-formaldehyde resin, a melamine resin, a benzoguanamine resin, a urea resin, a polyamide resin etc.; a silicone resin; an epoxy resin etc.

These may be used alone or in combination of two or more.

In the carrier of the exemplary embodiment, examples of the resin which is a main component of particularly an outermost resin-coated layer among the resin-cote layers include polyester, styrene, acryl, a copolymer of styrene and acryl, and urethane. Among them, polyester, and a copolymer of styrene and acryl having the acid value of 0.2 mgKOH/g to 10.0 mgKOH/g are preferable.

Examples of the resin which is a main component of a resin-coated layer adjacent to an outermost resin-coated layer of the resin-coated layers include polyester, styrene, acryl, a copolymer of styrene and acryl, polyurethane, urea, polyamide, polycarbonate, and phenol resin. Among them, polyester, styrene, acryl, polyurethane, urea, and phenol resin having the acid value of 1.0 mgKOH/g to 20.0 mgKOH/g are preferable.

The resin-coated layer may contain a dispersed resin particle in addition to the aforementioned resins which are to be a main component.

Examples of the resin particle include a thermoplastic resin particle, and a thermosetting resin particle. Among them, the thermosetting resin whose hardness may be increased relatively easily is suitable. And, in order to impart the negative charging property to the toner, it is preferable to use a resin particle containing a nitrogen atom. These resin particles may be used alone, or two or more kinds of them may used jointly.

It is preferable that the resin particle is dispersed uniformly in the resin as a main component in a direction of a thickness of a coating resin layer, and in a direction tangential with the carrier surface. When a resin of the resin particle and a matrix resin have high compatibility, uniformity of dispersion in the coating resin layer of the resin particle is improved, being preferable.

Examples of the thermoplastic resin include a polyolefin-base resin such as polyethylene, polypropylene etc.; polyvinyl and polyvinylidene-based resins such as polystyrene, acryl resin, polyacrylonitrile, polyvinyl acetate, polyvinyl alcohol, polyvinyl butyral, polyvinyl chloride, polyvinyl carbazole, polyvinyl ether, polyvinyl ketone etc.: a vinyl chloride-vinyl acetate copolymer; a styrene-acrylic acid copolymer; a straight silicone resin consisting of an organosiloxane bond, or a modified resin thereof; a fluorine resin such as polytetrafluoroethylene, polyvinyl fluoride, polyvinylidene fluoride, polychlorotrifluoroethylene etc.; polyester polyurethane; polycarbonate etc.

Examples of the thermosetting resin used in the resin particle include a phenol resin; an amino resin such as a urea-formaldehyde resin, a melamine resin, a silicone resin, a benzoguanamine resin, a urea resin, a polyamide resin etc.; an epoxy resin and the like.

The resin of the resin particle and the resin as a main component may be the same kind material, or different kind materials. Particularly preferably, the resin of the resin particle and the resin as a main component consist of different kind materials.

When the thermosetting resin particle is used as the resin of the resin particle, a mechanical strength of the carrier may be improved, being preferable. Particularly, a resin having a crosslinked structure is preferable. In order to make the function as a charging site of the resin particle better, it is preferable to use a resin which is rapid in start of toner charging and, as such the resin particle, a particle of a nitrogen-containing resin such as a nylon resin, an amino resin, and a melamine resin is preferable.

The resin particle may be produced by a method of producing a Granulated resin particle utilizing polymerization such as emulsion polymerization and suspension polymerization, a method of dispersing a monomer or an oligomer in a solvent, and granulating this while a crosslinking reaction proceeds, to produce a resin particle, or a method of mixing and reacting a low-molecular component, and a crosslinking agent by melt kneading, grinding this into a predetermined particle size by a wind force or a mechanical force to produce a resin particle.

A volume average particle diameter of the resin particle is preferably 0.1 μm to 2.0 μm, more preferably 0.2 μm to 1.0 μm. When the diameter is less than 0.1 μm, dispersibility in the coating resin layer is reduced and, on the other hand, when the diameter is more than 2 μm, peeling from the coating resin layer is easily caused, and stable charging property is not obtained in some cases. A method of measuring the volume average particle diameter of the resin particle is the same as that for the volume average particle diameter of the core material.

The resin particle is contained in a coating resin layer preferably at 1% by volume to 50% by volume, more preferably 1% by volume to 30% by volume, further preferably 1% by volume to 20% by volume. When a content of the resin particle in the coating resin layer is less than 1% by volume, the effect of the resin particle is not manifested and, when the resin particle is more than 50% by volume, peeling from the coating resin layer is easily caused, and stable charging property is not obtained in some cases, being not preferable.

The resin-coated layer may further contain an electrically conductive powder by dispersing it.

Examples of the electrically conductive powder include a metal such as gold, silver and copper; carbon black; a metal oxide such as titanium oxide, magnesium oxide, zinc oxide, aluminum oxide, calcium carbonate, aluminum borate, potassium titanate, and calcium titanate powders; powders in which a surface of titanium oxide, zinc oxide, barium sulfate, aluminum borate, or potassium titanate powder is covered with tin oxide, carbon black or a metal. These may be used alone, or two or more kinds may be used together. When a metal oxide is used as the electrical conducted particle, environmental dependency of the charging property can be further reduced, being preferable. Titanium oxide is particularly preferable.

Furthermore, it is preferable to treat a particle composed of the aforementioned material with a coupling agent. Among them, a metal oxide treated with a coupling agent is preferable, and titanium oxide treated with a coupling agent is particularly preferable. The electrically conductive powder treated with a coupling agent may be obtained by dispersing an untreated electrically conductive powder in a solvent such as toluene, then, mixing-treating the dispersion with a coupling acent and drying this under reduced pressure.

Furthermore, in order to remove an aggregate from the resulting electrically conductive powder treated with a coupling agent, the powder may be milled with a milling machine. As the milling machine, the known milling machine such as a pin mill, a disk mill, a hammer mill, a centrifugation classification-type mill, a roller mill, and a jet mill may be used, and the jet mill is particularly preferable. As the coupling agent to be used, the known coupling agent such as a silane coupling agent, a titanium coupling agent, an aluminum coupling agent, and a zirconium coupling agent may be used.

Among them, when the electrically conductive powder treated with a silane coupling agent, particularly methyltrimethoxysilane is used, this is particularly effective on environmental stability of charging.

A volume average particle diameter of the electrically conductive powder is preferably 0.5 μm or less, more preferably 0.05 μm to 0.45 μm, further preferably 0.05 μm to 0.35 μm. A method of measuring the volume average particle diameter of the electrically conductive powder is according to the method of measuring a volume average particle diameter of the core material.

When the volume average particle diameter of the electrically conductive powder is more than 0.5 μm, peeling from the coating resin layer is easily generated, and stable charging property is not obtained in some cases, being not preferable.

The electrically conductive powder has a volume electric resistance of preferably $10^1$ Ω·cm to $10^{11}$ Ω·cm, more preferably $10^3$Ω·cm to $10^9$Ω·cm. Herein, the volume electric resistance of the electrically conductive powder refers to a value measured by the following method.

The electrically conductive powder is filled into a container having a cross-sectional area of $2\times10^{-4}$ $m^2$ at a thickness of about 1 mm under a normal temperature and a normal humidity (temperature 20° C., humidity 50% RH), thereafter, a road of $1\times10^4$ $kg/m^2$ is applied to the filled electrically conductive powder with a metal member. A voltage generating an electric field of $10^6$V/m is applied between the metal member and a bottom electrode of the container, and a value calculated from a current value thereupon is adopted as a volume electric resistance value.

The electrically conductive powder is contained in the coating resin layer usually at 1% by volume to 80% by volume, preferably 2% by volume to 20% by volume, further preferably 3% by volume to 10% by volume.

A total coating amount of each of the resin-coated layers is preferably 1.0% by mass to 3.0% by mass, more preferably 1.5% by mass to 2.5% by mass. When the total coating amount is more than 3.0% by mass, a coating resin is peeled from the carrier with time, and inconvenience is caused in some cases. When the total coating amount is less than 1.0% by mass, a resin component covering a surface of the core is deficient, and resistance may not be retained relative to an applied voltage.

An average thickness of each of the resin-coated layers is preferably 0.1 μm to 10 μm, more preferably 0.1 μm to 3.0 μm, further preferably 0.1 μm to 1.0 μm. When the average thickness of the resin-coated layer is less than 0.1 μm, reduction in resistance due to peeling of the coating layer is generated at long term use, and it becomes difficult to sufficiently control grinding of the carrier and, on the other hand, when the average thickness is more than 10 μm, a time until a charging amount reaches a saturated charging amount is necessary in some cases.

Saturated magnetization of the carrier of the exemplary embodiment is preferably 40 emu/g or more, more preferably 50 emu/g or more.

As an apparatus for measuring the magnetic property, a sample vibration-type magnetization measuring apparatus (trade name VSMP10-15, manufactured by Toei Industry Co., Ltd.) is used. A measurement sample is charged into a cell having an internal diameter of 7 mm and a height of 5 mm, and is set in the apparatus. Upon measurement, a magnetic field is applied, and sweeping is performed up to maximum 1000 oersted. Then, an application magnetic field is decreased, and a hysteresis curve is produced on a recording paper. From data of the curve, saturated magnetization, residual magnetization and a coercive force are obtained. In the invention, saturated magnetization indicates magnetization measured in a magnetic field of 1000 oersted.

A volume electric resistance of the carrier in the invention is controlled preferably in a range of $1\times10^7$Ω·cm to $1\times10^{15}$ Ω·cm, more preferably in a range of $1\times10^8$Ω·cm to $1\times10^{14}$ Ω·cm, further preferably in a range of $1\times10^8$ Ω·cm to $1\times10^{13}$ Ω·cm.

When the volume electric resistance of the carrier is more than $1\times10^{15}$ Ω·cm, since the carrier becomes high resistant, and works as a development electrode with difficulty at development, solid reproductivity is reduced in some cases, such as appearance of the edge effect particularly at a plain image part. On the other hand, when the volume electric resistance is less than $1\times10^7$Ω·cm, since the carrier becomes low resistant, such inconvenience is easily generated that a charge is injected into the carrier from a developing roll when the toner concentration in a developer is reduced, and the carrier itself is developed in some cases.

The volume electric resistance (Ω·cm) of the carrier is measured as follows. The measurement environment is a temperature of 20° C. and a humidity of 50% RH.

The carrier to be measured is placed flat at a thickness of about 1 mm to about 3 mm on a surface of a circular tool on which an electrode plate of 20 $cm^2$ is disposed, to form a carrier layer. The same electrode plate of 20 $cm^2$ is placed thereon, holding the carrier layer. In order to eliminate a cap between carriers, a load 4 kg is applied on the electrode plate disposed on the carrier layer and, thereafter, a thickness (cm) of the carrier layer is measured. Both electrodes on and under the carrier layer are connected to an electrometer and a high voltage source generating device. A high voltage is applied to both electrodes so that an electric field becomes $10^{3.8}$ V/cm, and a current value (A) flown thereupon is read, thereby, the volume electric resistance (Ω·cm) of the carrier is calculated. A calculation equation of the volume electric resistance (Ω·cm) of the carrier is as shown by the following equation (B).

$$R=E\times20/(I-I_0)/L \qquad \text{Equation (B)}$$

In the equation, R represents a volume electric resistance (Q·cm) of the carrier. E represents an application voltage (V), I represents a current value (A), ID represents a current value (A) at an application voltage of 0V, and L represents a thickness (cm) of the carrier layer, respectively. In addition, a coefficient 20 represents an area ($cm^2$) of the electrode plate.

The aforementioned carrier related to the exemplary embodiment having at least two resin-coated layers on core the material surface, when it has two resin-coated layers, may be manufactured, for example, as follows. First, the resin which is to be a main component of a lower resin-coated layer is dissolved in toluene at a solid matter of 10% by mass to 25% by mass, to prepare a resin solution. Then, the core material composed of ferrite, and the resin solution are placed into a kneader so that the resin is 1.5% by mass to 3.0% by mass based on the core material, and this is stirred and mixed under reduced pressure under the condition of 50° C. or higher and 80° C. or lower. After toluene is vaporized, evacuation is stopped, and a produced carrier is taken out. Further, the resin which is to be a main component of an upper (surface) resin-coated layer is dissolved in toluene at a solid matter of 10% by mass to 25% by mass. Thereupon, for the purpose of adjusting a resistance, and adjusting charging, an electrically conductive particle may be added. In this case, it is preferable to disperse the electrically conductive particle using a sand mill. The thus obtained resin solution is placed into a kneader so that the resin is 1.5% by mass to 3.0% by mass based on the core material coated with a lower resin-coated layer, and this is stirred and mixed under reduced pressure under the condition of 50° C. or higher and 70° C. or lower. After completion of drying, a produced carrier is taken out.

Alternatively, the following method may be also used preferably.

According to the same manner as that of the aforementioned method, the resin which is to be a main component of the lower resin-coated layer is dissolved in toluene at a solid matter of 4% by mass to 20% by mass. Further, the resin which is to be a main component of an upper (surface) resin-coated layer is dissolved at a solid matter of 4% by mass to 20% by mass. Thereupon, the electrically conductive particle may be added as in the aforementioned method. Then, the core material is placed into a fluidized coating apparatus, and the resin solution for forming a lower resin-coated layer at such an amount that the resin becomes 2% by mass based on the core material is coated at a rate of 5 g/min to 30 g/min. After completion, the resin solution for forming an upper resin-coated layer is subsequently coated thereon similarly so that the resin becomes 3% by mass based on the core material. An atmospheric temperature is set at 60° C. or higher and 90° C. or lower and, after drying, a produced carrier is taken out.

When such resins that SP values of a lower resin-coated layer and an upper resin-coated layer are near (difference is 1.0 $J^{1/2}/m^{3/2}$ or less as expressed by absolute value) are overlaid, the following method is preferably used. Using the fluidized coating apparatus, the resin solution for forming a lower resin-coated layer is coated according to the same manner as that of the aforementioned method. On the other hand, as the resin solution for forming an upper resin-coated layer, a resin solution in which a resin emulsified with a surfactant or self-emulsified with alkali treatment is dispersed in water is used, and this is coated at a coating rate of 5 g/min to 30 g/min at a solid matter of 5% by mass to 25% by mass. An atmospheric temperature is set at 70° C. or higher and 90° C. or lower.

In the above methods, toluene was used as a solvent, but the solvent is not limited to this, and organic solvents such as ketones such as MEK (methyl ethyl ketone), and MIBK (methyl isobutyl ketone), alcohols such as IPA (isopropyl alcohol), hydrocarbons such as cyclohexane and esters such as ethyl acetate and butyl acetate may be used.

The developer related to the exemplary embodiment contains a toner.

Then, the toner which may be used in the exemplary embodiment will be explained.

The toner which may be used in the exemplary embodiment is not particularly limited, but contains at least a binding resin and a coloring, agent.

As the binding resin contained in the toner, the known binding resin which may be used in a toner particle may be conveniently selected. Specifically, examples include homopolymers or copolymers of monoolefin such as ethylene, propylene, butylene, isoprene etc.; vinyl esters such as vinyl acetate, vinyl propionate, vinyl benzoate, vinyl butyrate etc.; α-methylene aliphatic monocarboxylic acid esters such as methyl acrylate, phenyl acrylate, octyl acrylate, methyl methacrylate, ethyl methacrylate, butyl methacrylate, dodecyl methacrylate etc.; vinyl ethers such as vinyl methyl ether, vinyl ethyl ether, vinyl butyl ether etc.; vinyl ketones such as vinyl methyl ketone, vinyl hexyl ketone, vinyl isopropenyl ketone etc.

Among them, examples of a representative binding resin include polystyrene, styrene-alkyl acrylate copolymer, styrene-butadiene copolymer, styrene-maleic anhydride copolymer, polystyrene, and polypropylene. Further examples include polyester, polyurethane, epoxy resin, silicone resin, polyamide, and modified rosin.

The coloring agent is not particularly limited, but carbon black, aniline blue, chalcoil blue, chrome yellow, ultramarine blue, Dupont Oil Red, quinoline yellow, methylene blue chloride, phthalocyanine blue, Malachite Green Oxalate, lamp black, Rose Bengal, C.I.Pigment Red 48:1, C.I.Pigment Red 122, C.I.Pigment Red 57:1, C.I.Pigment Yellow 97, C.I.Pigment Yellow 12, C.I.Pigment Blue 15:1, and Pigment Blue 15:3 may be used.

A charge controlling agent may be added to the toner as necessary. When the charge controlling agent is added to a color toner, a colorless or pale colored charge controlling agent which does not influence on a tone is preferable. As the charge controlling agent, the known charge controlling agent may be used, and an azo metal complex, and a metal complex or a metal salt of salicylic acid or alkylsalicylic acid are preferably used.

In addition, the toner may contain other known component such as an offset preventing agent such as low molecular weight polypropylene, low molecular weight polyethylene and wax. As the wax, paraffin wax and derivatives thereof, montan wax and derivatives thereof, microcrystalline wax and derivatives thereof, Fischer Tropsch wax and derivatives thereof, and polyolefin wax and derivatives thereof may be used. The derivatives may include an oxide, a polymer of the wax with a vinyl monomer and a graft modified wax. In addition, alcohol, fatty acid, vegetable wax, animal wax, mineral wax, ester wax, and acid amide may be used.

In the invention, in order to improve transferability, flowability, cleanability and controllability of a charge amount, particularly flowability, the toner may contain an external additive. The external additive refers to an inorganic particle which is adhered to a surface of a core particle of the toner.

As the inorganic particle, $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)$, (n is an integer of 1 to 4), $Al_2O_3.2SiO_2$, $CaCO_3$, $MgCO_3$, $BaSO_4$, and $MgSO_4$ may be used. Among them, particularly a silica particle and a titania particle are preferable due to better flowability.

A surface of the inorganic particle of the external additive is desirably hydrophobicization-treated in advance. By this hydrophobicization-treatment, powder flowability of the toner is improved. In addition, the treatment is also effective in environmental dependency of charging, and carrier staining resistance. Hydrophobicization treatment may be performed by dipping an inorganic particle in a hydrophobicization-treating, agent. The hydrophobicization-treating agent is not particularly limited, but examples include a silane coupling agent, a silicone oil, a titanate coupling agent, and an aluminum coupling agent. These may be used alone, or two or more kinds may be used together. Among them, the silane coupling agent is preferable.

As the silane coupling agent, for example, any type of chlorosilane, alkoxysilane, silazane, and special silylating agent may be used. Specifically, examples include methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltriethoxysilane, decyltrimethoxysilane, hexamethyldisilazane, N,O-(bistrimethylsilyl)acetamide, N,N-(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxycyclohexyl)ethyltrimethoxysilane, γ-glycidoxypropyltrimethoxysilane, γ-glycidoxypropylmethyldiethoxysilane, γ-mercaptopropyltrimethoxysilane, and γ-chloropropyltrimethoxysilane. An amount of the hydrophobicization treating agent to be used is different depending on a kind of the inorganic particle, and can not be unconditionally defined, but is suitably in a range usually of 5 parts by mass to 50 parts by mass with respect to 100 parts by mass of the inorganic particle.

A hydrophobicization degree of the external additive with the hydrophobicization treating agent is preferably 40% to 100%, more preferably 50% to 90%, and further preferably 60% to 90%.

The hydrophobicization degree in the invention is defined as a hydrophobicization degree (M) represented by the following equation, when 0.2 g of a particle is added to 50 cc of water, the mixture is stirred with a stirrer and titrated with methanol, and the particle is suspended in a solvent, wherein a methanol titration amount is defined as Tcc.

Hydrophobicization degree($M$)=[$T$/50+$T$]×100(vol. %)

The volume average particle diameter of the toner particle is preferably 2 μm to 12 μm, more preferably 3 μm to 10 μm, further preferably 4 μm to 9 μm. When the volume average particle diameter of the toner particle is less than 2 μm, since flowability is remarkably reduced, formation of the developer layer with a layer regulating member becomes insufficient, and fog and dirt are generated in an image in some cases. On the other hand, when the volume average particle diameter is more than 12 μm, resolution is reduced, and an image of high quality is not obtained in some cases, or an charging amount per unit weight of the developer is reduced, durability of formation of the developer layer is reduced and, fog and dirt are generated in an image in some cases.

In a method of measuring a volume average particle diameter of the toner particle, 0.5 mg to 50 mg of a measurement sample is added to 2 ml of a 5 mass % aqueous solution of a surfactant, preferably sodium alkylbenzenesulfonate as a dispersant. The mixed solution is added to 100 ml to 150 ml of the electrolyte solution. This electrolyte solution in which the measurement sample is suspended is dispersion-treated with an ultrasound dispersing equipment for about one minute, and a particle size distribution of particles in a range of 2.0 μm to 60 μm in terms of particle diameter is measured using an aperture of an aperture diameter of 100 μm by Coultermultisizer II type (manufactured by Beckman Coulter). The number of particles to be measured is 50,000.

For a divided particle size range (channel) of the resulting particle size distribution, a volume accumulation distribution is subtracted from a small particle diameter side, and a particle diameter at accumulation 50% is adapted as a volume average particle diameter $D_{50v}$.

The method of producing a toner is not particularly limited, but the known method such as a dry process such as a kneading grinding method, and a wet granulation method such as a melt suspending method, an emulsification aggregating method, and a dissolution suspending method may be conveniently applied.

Then, an image forming method using the image forming apparatus of FIG. 1 will be explained. Formation of the toner image is performed for every developing unit, a surface of the photoreceptor 79 rotating in a counterclockwise direction is charged with the charging roll 83, a latent image is formed on a surface of the charged photoreceptor 79 with a laser generating apparatus 78, then, this latent image is developed with a developer supplied from the developing equipment 85 to form a toner image, and the toner image brought to a pressure-contact part between the primary transferring roll 80 and the photoreceptor 79 is transferred onto an external circumferential surface of the intermediate transfer belt 86 which is rotated in an arrow A direction. The toner and the trash adhered to a surface of the photoreceptor 79 after transference of the toner image are cleaned with a photoreceptor cleaner 84, and this is ready for formation of a next toner image.

Toner images developed for every developing unit of each color are brought to the secondary transferring part in the state where they are sequentially piled on an external circumferential surface of the intermediate transfer belt 86 so as to correspond to image information, and are transferred onto a surface of the recording paper which has been conveyed from the recording medium accommodating part 77 via the paper passageway 76 with the secondary transferring roll 75. The recording paper onto which the toner image has been transferred is fixed by pressure-heating when it passes through a pressure-contact part of one pair of fixing rolls 72 which further constitute a fixing part and, after formation of an image on a surface of the recording paper, is discharged to the outside of the image formation apparatus.

The present exemplary embodiment is constructed as a so-called tandem-type image forming apparatus which carries four developing unit, and may form an image by one pass from a viewpoint of high speed printability. In the case of the tandem-type image forming apparatus, the photoreceptor and the developing equipment are usually configured so that they are opposite to each other. Further, it is difficult to adjust a photoreceptor potential and a developing roll potential at initiation and completion of an image forming cycle. For this reason, the carrier is easily flown onto the photoreceptor.

In the exemplary embodiment, since a predetermined intermediate transfer belt and a developer containing a predetermined carrier are used, generation of a cracked species of the carrier in the developing equipment or between the photoreceptor and the intermediate transfer belt may be prevented. For this reason, sticking of the cracked species of the carrier in a photoreceptor surface, and generation of a flaw on a photoreceptor surface are suppressed, occurrence of breakage of a blade edge part when a cleaning blade is used as a cleaning unit is suppressed and unevenness of adhesion of a toner component onto a surface of the charging equipment when a contact-type charging equipment is used is suppressed.

In the exemplary embodiment, a relationship between a circumferential speed V(P/R) of the photoreceptor 79, a circumferential speed V(Belt) of the intermediate transfer belt 86, and a conveying speed V(PP) of the recording paper is not particularly limited, but it is preferable that a relationship of the following equation 1 and the equation 2 is satisfied. By satisfying a relationship of the following equation 1 and equation 2, generation of a flaw on a surface of a photoreceptor when a cracked species of the carrier is generated in the developing equipment or when a foreign matter such as carbon fiber is mixed in the image forming apparatus may be effectively suppressed.

$$V(P/R) \approx V(PP) < V(\text{Belt}) \quad \text{Equation 1}$$

$$V(\text{Belt})/V(P/R) = 1.05 \text{ to } 1.15 \quad \text{Equation 2}$$

The effect obtained by satisfying a relationship of the equation 1 and the equation 2 will be explained below by referring to an example of the case where a cracked species of the carrier is generated in the developing equipment.

When the cracked species of the carrier generated in the developing equipment 85 is flown onto the photoreceptor 79 and is adhered onto a surface thereof, the cracked species of the carrier is brought to a pressure-contact part (nip) between the photoreceptor 79 and the primary transferring roll 80 with rotation in a counterclockwise direction of the photoreceptor 79. At the pressure-contact part, a primary transference electric field is formed between the photoreceptor 79 and the primary transferring roll 80, and the cracked species of the carrier stands up against a surface of the photoreceptor along this electric field in a vicinity of the pressure-contact part. When the cracked species of the carrier enters the pressure contact part in the stood up state, a tip of the cracked species is contacted with a surface of the intermediate transfer belt 86, but since a predetermined circumferential speed difference is imparted between V(Belt) and V(P/R), the cracked species becomes in the state where it is tilted relative to a surface of the photoreceptor 79. For this reason, it becomes difficult for the cracked species to stick into a surface of the photoreceptor 79 and, as a result, generation of a flaw on the surface of the photoreceptor may be suppressed.

When a foreign matter such as a carbon fiber is mixed into the developing equipment, or when the cracked species of the carrier or the foreign matter is adhered on the surface of the intermediate transfer belt, generation of a flaw on the surface of the photoreceptor may be suppressed with respect to the same reason.

In the exemplary embodiment, a circumferential speed V(P/R) of the photoreceptor 79, a circumferential speed V(Belt) of the intermediate transfer belt 86, and a conveying speed V(PP) of the recording paper may satisfied a relationship of the following equation 3 and equation 4. In this case, the toner image is formed by V(P/R)/V(Belt)-fold reduction relative to a rotation direction of the photoreceptor 79, on the surface of the photoreceptor 79.

$$V(P/R)<V(PP)\approx V(\text{Belt}) \quad \text{Equation 3}$$

$$V(\text{Belt})/V(P/R)=1.05 \text{ to } 1.15 \quad \text{Equation 4}$$

Since a predetermined circumferential speed difference may be imparted between V(Belt) and V(P/R) also by satisfying the equation 3 and the equation 4, generation of a flaw on the surface of the photoreceptor may be suppressed for the same reason as that of the case where the equation 1 and the equation 2 are satisfied.

Secondary Exemplary Embodiment

Figure 2:
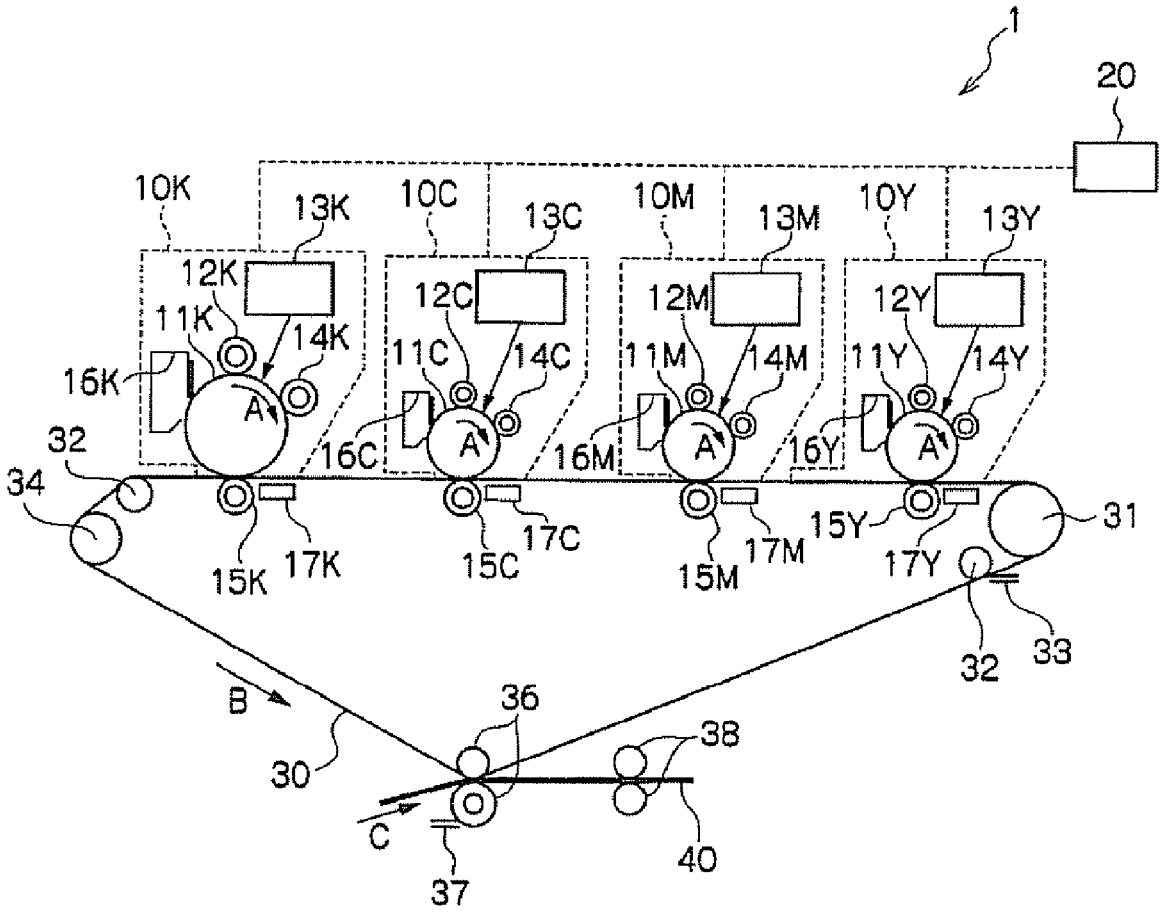
FIG. 2 is a schematic construction view showing the image forming apparatus of the invention of a second exemplary embodiment.

FIG. 2 is a schematic construction view showing the image forming apparatus of the invention related to the second exemplary embodiment. The exemplary embodiment is constructed as an intermediate transferring manner image forming apparatus equipped with an intermediate transfer belt, and is further equipped with an electric field generating unit for generating an electric field in a direction crossing with a direction of an electric field generated by the primary transfer unit at a position aligning on an upstream side in a rotation direction of the intermediate transfer belt relative to the image holding member. Also in the exemplary embodiment, the same developer as that of the first exemplary embodiment is used.

Specifically, this image forming unit 1 is a tandem-type printer in which image forming units 10Y, 10M, 10C and 10K are arranged in parallel for each color of yellow (Y), magenta (M), cyan (C) and black (K), and may print a monochromatic image and, additionally, may print a full color image consisting of such four color developed image (toner image). Since these four image forming units 10Y, 10M, 10C and 10K have approximately the same construction, they are explained collectively by fundamentally omitting symbols Y, M, C and K in FIG. 2 and, only when each color element is explained individually, the element is explained by marking with a symbol of the color Y, M, C or K.

Each image forming unit 10 comprises the photoreceptor (image holding member) 11, the charging equipment (charging unit) 12, the light exposing equipment (latent image forming unit) 13, the developing equipment (developing unit) 14, the primary transferring equipment (primary transfer unit) 15, and the photoreceptor cleaner (cleaning unit) 16, respectively. The same two-component developer as that of the first exemplary embodiment is accommodated in the developing equipment 14.

In addition, the image forming apparatus 1 comprises the control part 20, the intermediate transfer belt 30, the driving roll 31, the dependent roll 32, the intermediate transfer belt cleaner 33, the steering roll 34, the secondary transferring equipment (secondary transfer unit 36), and the transferring cleaner 37 which are common to respective image forming units 10. A surface hardness on a side contacting with the photoreceptor 11 of the intermediate transfer belt 30 is 10 to 30.

The photoreceptor 11 is rotated in an arrow A direction and the intermediate transfer belt 30 is circulated in an arrow B direction. On an upstream side in a circulation passageway of the intermediate transfer belt 30 of each image forming unit 10, a tilting equipment 17 which corresponds to one example of an electric field generating unit, and tilts an electrically conductive foreign matter such as carbon fiber adhered on the intermediate transfer belt 30 against the photoreceptor 11 is arranged. The tilting equipment 17 will be explained in detail later.

A fundamental operation in image formation of this image forming apparatus 1 will be explained.

First, for getting ready for image formation, the photoreceptor 11 for each color is rotation-driven, and a predetermined charge is imparted to a surface of the photoreceptor 11 with the charging equipment 12.

Subsequently, a manuscript image is read with an image reading device (not shown) to produce color separation data of for colors Y, M, C and K. Color separation data of each color is sent to the light exposing part 13 of the image forming unit 10 of a corresponding color.

When preparation for image formation is completed, first, development image formation is initiated with the image forming unit 10Y of yellow. By the light exposing part 13Y of yellow, a surface of the photoreceptor 11Y is irradiated with laser light corresponding to a yellow color separation image to form an electrostatic latent image. The electrostatic latent image is developed with a developer of yellow contained in a developer which is circulation-supplied with the developing equipment 14Y to form a development image of a yellow toner on the photoreceptor 11Y.

When the development image of the yellow toner is formed on the photoreceptor 11Y, the development image of the yellow toner formed on the photoreceptor 11Y is transferred onto the intermediate transfer belt 30 with the primary transferring equipment 15Y.

In addition, when the development image on the photoreceptor 11Y is transferred onto the intermediate transfer belt 30, a residual toner remaining on the photoreceptor 11Y is removed by scraping with the photoreceptor cleaner 16Y.

The intermediate transfer belt 30 is circulation-moved in an arrow B direction with the driving roll 31 and the dependent roll 32 and, at the same time, position slippage in a width direction is corrected with the steering roll 34. In conformity with timing at which the development image of the yellow toner transferred onto this intermediate transfer belt 30 reaches the first transferring equipment 15M of the image forming unit 10M of magenta which is a next color, so that the development image of the magenta toner reaches the first transferring equipment 15M, a development image is formed with the image forming unit 10M of magenta. The thus formed development image of the magenta toner is transferred overlaying on the development image of the yellow toner on the intermediate transfer belt 30 with the primary transferring equipment 15M.

Subsequently, development image formation with image forming units 10C and 10K of cyan and black is performed at the same timing as that described above, and development images are sequentially transferred overlaying on development images of the yellow toner and the magenta toner of the intermediate transfer belt 30 in primary transferring equipments 15C and 15K.

Thus, the development image of the multicolor toner transferred onto the intermediate transfer belt 30 is secondarily transferred onto the recording paper 40 with the secondary transferring equipment 36, the multicolor development image is conveyed together with the recording paper 40 in an arrow C direction, and is fixed on the recording paper 40 with the fixing equipment (fixing unit) 38, to form the color image. The residual toner remaining on the secondary transferring equipment 36 is removed with the transfer body cleaner 37, the residual toner remaining on the intermediate transfer belt 30 after transference is removed with the intermediate transfer belt cleaner 33, and the preparation is performed for forming a next image.

Fundamentally, an image is formed on the recording paper as described above.

Subsequently, operation in the tilting equipment 17 and control with the control part 20 will be explained in the detail.

Figure 3:
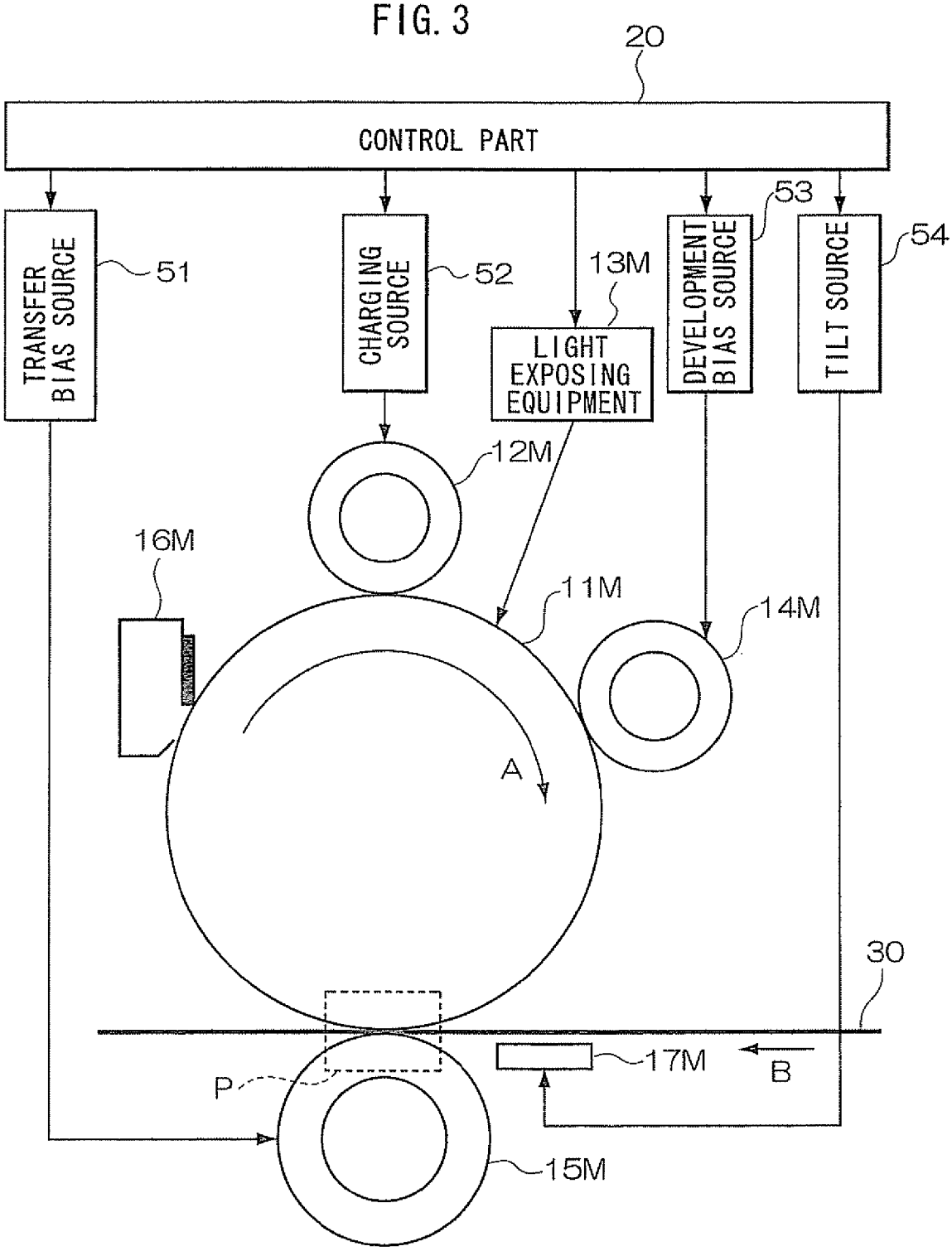
FIG. 3 is a schematic construction view of an image forming unit, an inclining equipment, and a control part.
Figure 4:
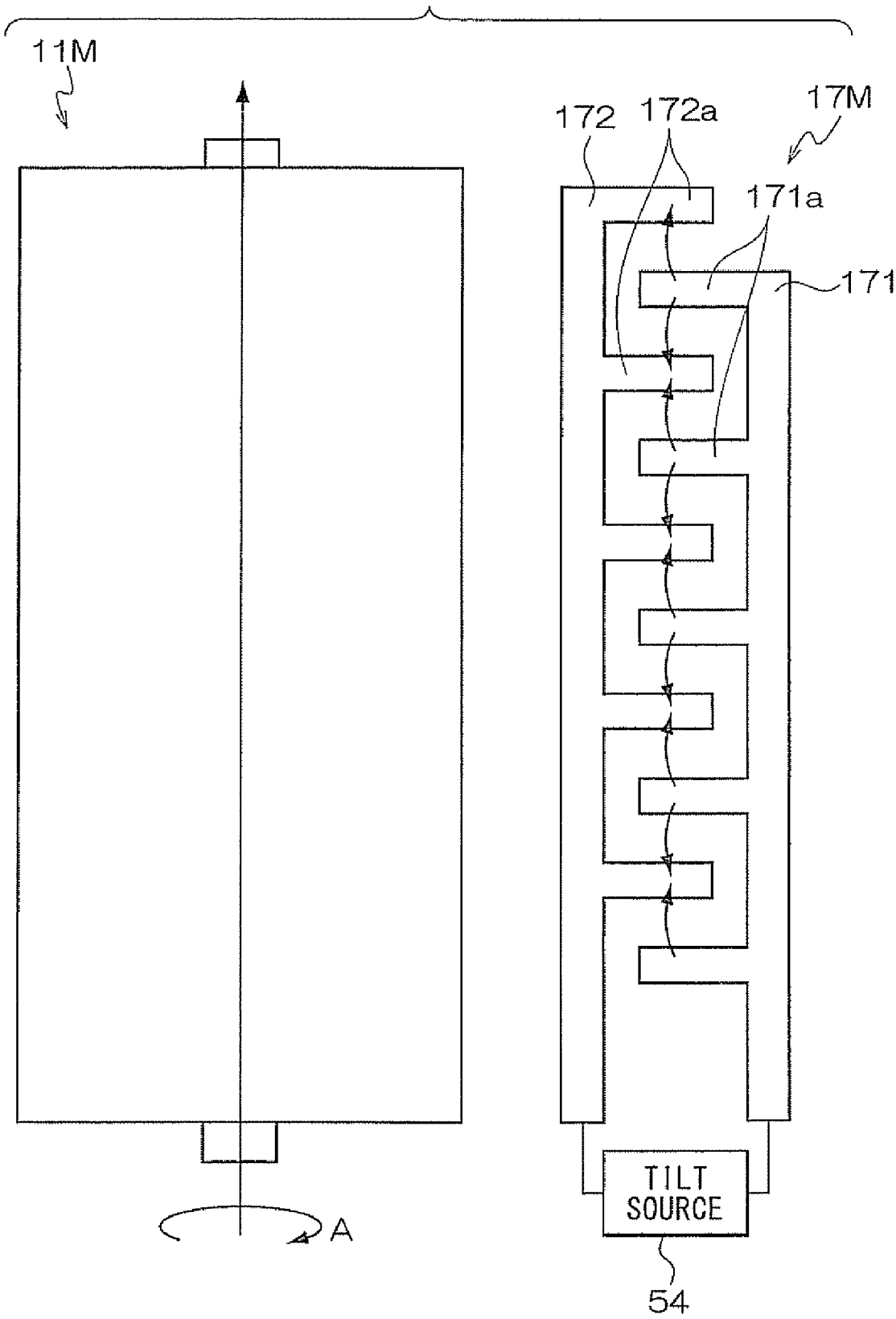
FIG. 4 is a schematic construction view of the inclining equipment.
Figure 5:
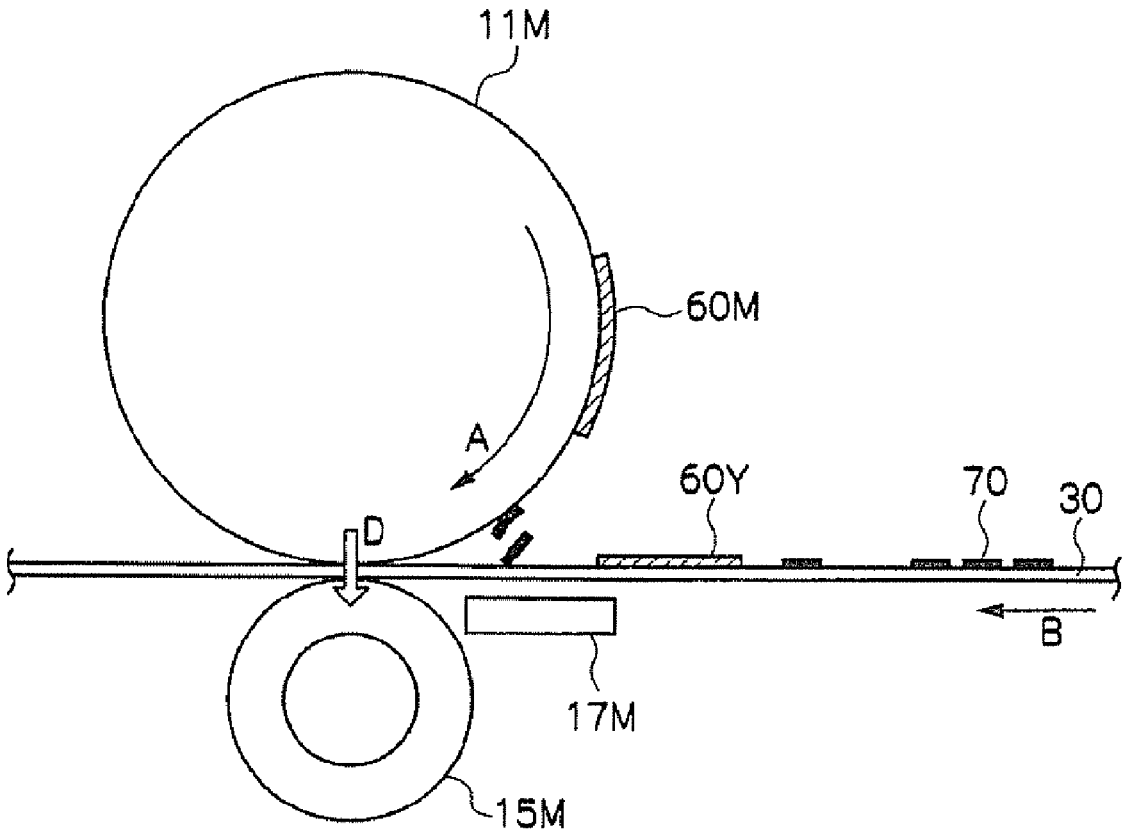
FIG. 5 is a view for explaining a method of inclining an electrically conductive foreign matter.

FIG. 3 is a schematic construction view of the image forming unit 10, the tilting equipment 17, and the control part 20, FIG. 4 is a schematic construction view of the tilting equipment 17, and FIG. 5 is a view for explaining a method of tilting an electrically conductive foreign matter.

Since four image forming units 10Y, 10M, 10C, and 10K, and tilting equipments 17Y, 17M, 17C, and 17K have approximately the same construction, the image forming unit 10M and the tilting equipment 17M, of magenta will be explained as a representative of those image forming units 10Y, 10M, 10C, and 10K, and tilting equipments 17Y, 17M, 17C, and 17K in FIG. 3 and FIG. 4. Hereinafter, explanation will be performed on the assumption that the toner used for image formation is charged minus.

As shown in FIG. 3, the tilting equipment 17M is arranged on a side opposite to the photoreceptor 11M holding the intermediate transfer belt 30, on an upstream side of a transference position P where the photoreceptor 11M and the intermediate transfer belt 30 are contacted, in a circulation passageway of the intermediate transfer belt 30.

As shown in FIG. 4, the tilting equipment 17M is constructed of one pair of comb-shaped electrodes 171, 172 in which plural comb teeth 171*a*, 172*a* are aligned alternatively, and comb-shaped electrodes 171, 172 are arranged so that a direction of alignment of comb teeth 171*a*, 172*a* is along an axial direction of the photoreceptor 11M. Comb teeth 171*a*, 172*a* correspond to one example of comb teeth referred in the invention, and comb-shaped electrodes 171, 172 correspond to both of one example of one pair of electrodes, and one example of one pair of comb-shaped electrodes referred in the invention.

The charging equipment 12M, the developing equipment 14M, the primary transferring equipment 15M, and the tilting equipment 17M are equipped with an charging source 52, a development bias source 53, a transfer bias source 51, and a tilt source 54 for applying a bias voltage, respectively, and the control part 20 controls operation of the charging equipment 12M, the developing equipment 14M, the primary transferring equipment 15M, and the tilting equipment 17M by controlling an application voltage with those charging source 52, development bias source 53, transfer bias source 51, and tilt source 54.

Upon formation of the development image, the photoreceptor 11M is rotated in an arrow A direction to circulate the intermediate transfer belt 30 in an arrow B direction and, at the same time, an charging voltage is applied to the charging equipment 12M by the charging source 52, a development bias voltage is applied to the development equipment 14M by the development bias source 53, a transference bias voltage is applied to the primary transferring equipment 15M by the transfer bias source 51, and a voltage for the tilting equipment 17 is applied to each of one pair of comb-shaped electrodes 171, 172 of the tilting equipment 17 by the tilt source 54

When an charging voltage is applied to the charging equipment 12M, a predetermined charge is imparted to a surface of the photoreceptor 11M.

Subsequently, laser light is irradiated to the photoreceptor 11M from the light exposing equipment 13M to form an electrostatic latent image on a surface of the photoreceptor 11M. The formed electrostatic latent image is conveyed to a development position between the development equipment 14M and the photoreceptor 11M accompanied with rotation of the photoreceptor 11M.

By applying a development bias voltage, a potential lower than a potential at a surface of the photoreceptor 11M is imparted to the development equipment 14M. In the development equipment 14M, the toner in the developer accommodated in an interior is charged minus and, by an electric field from a photoreceptor 11M side towards a developer equipment 14M side generated at the development position by application of the development bias voltage, the toner is attracted to a photoreceptor 11M side to be adhered to the electrostatic latent image, thereby, a development image of magenta is formed on the photoreceptor 11M.

The development image of magenta formed on the photoreceptor 11M is moved to a transfer position P accompanied with rotation of the photoreceptor 11M. At timing that the development image of magenta is moved to the transfer position P, a development image of yellow formed by the image forming unit 10Y of yellow on an upstream side is also conveyed to the transfer position P.

By applying the transfer bias voltage, a potential of attracting an charged toner particle is imparted to the primary transferring equipment 15M from a surface of the photoreceptor 11M, and an electric field from a primary transferring equipment 15M side towards a photoreceptor 11M side is generated in the transfer position P. In addition, by applying a weak voltage for the tilting equipment 17 to comb-shaped electrodes 171, 172 of the tilting equipment 17M, an electric field in a direction along an axis of the photoreceptor 11M is generated between alternately aligned comb teeth 171*a*, 172*a*. This electric field is an electric field in a direction crossing with an electric field generated at the transfer position P, and since intensity of an electric field generated between one pair of comb teeth 171*a*, 172*a* is small, the development image of a yellow toner on the intermediate transfer belt 30 passes over the tilting equipment 17M without being disintegrated, and is conveyed to the transfer position P.

The development image of the magenta toner formed on the photoreceptor 11M is attracted to the primary transferring equipment 15M by an electric field generated at the transfer position P, and the development image of the magenta toner on the photoreceptor 11M is duplicatively transferred to the development image of the yellow toner conveyed to the transfer position P by the intermediate transfer belt 30.

A residual toner which remains untransferred is adhered on the photoreceptor 11M after the development image has been transferred to the intermediate transfer belt 30. The residual toner is supplied to the photoreceptor cleaner 16M accompanied with rotation of the photoreceptor 11M, and scraped with the photoreceptor cleaner 16M.

In the image forming apparatus 1, formation of an image is performed by application of various bias voltages as described above.

Herein, upon exchange of the photoreceptor 11 or a toner cartridge (not shown), as shown in FIG. 5, an electrically conductive foreign matter 70 produced during manufacturing the image forming apparatus 1 is vibration-fallen on the intermediate transfer belt 30, and the electrically conductive foreign matter 70 is adhered on the intermediate transfer belt 30 in some cases. If this electrically conductive foreign matter 70 has been conveyed to the transfer position P by the intermediate transfer belt 30, the electrically conductive foreign matter 70 is stood up vertical to the photoreceptor 11 by application of the transfer bias voltage and, further by pushing of the intermediate transfer belt 30 against the photoreceptor 11M, there is a possibility that the electrically conductive foreign matter 70 is stuck in the photoreceptor 11M. In the image forming apparatus 1 of the exemplary embodiment, as explained below, by tilting of the electrically conductive foreign matter with the tilting equipment 17, inconvenience such as an image defect due to such the electrically conductive foreign matter is avoided.

The electrically conductive foreign matter 70 adhered on the intermediate transfer belt 30 is conveyed to a vicinity of the tilting equipment 17M accompanied with movement of the intermediate transfer belt 30 like the development image 60Y of the yellow toner. In the tilting equipment 17M, a weak electric field in a direction along an axis of the photoreceptor 11M, crossing with a transfer direction (arrow D direction) at the transfer position P is generated between plural comb teeth 171*a*, 172*a* by comb-shaped electrodes 171, 172 shown in FIG. 4. Since the tilting equipment 17M is arranged at a position very near the transfer position P, the development image 60Y passes over the tilting equipment 17M without being disturbed. On the other hand, the electrically conductive foreign matter 70 is stood up by generation of electrostatic inducement in the electrically conductive foreign matter 70 by a strong electric field generated at the transfer position P, but is tilted by an electric field generated in the tilting equipment 17M. As a result, since the electrically conductive foreign matter 70 is conveyed to the transfer position P in the state where it is tilted relative to a surface of the photoreceptor 11M, inconvenience of sticking in the photoreceptor 11M is avoided. In FIG. 5, 60M indicates the development image of the magenta toner.

The electrically conductive foreign matter 70 remaining on the photoreceptor 11M without sticking in the photoreceptor 11M is conveyed to the photoreceptor cleaner 16M, and is removed together with the residual toner by the photoreceptor cleaner 16M, and the electrically conductive foreign matter 70 remaining on the intermediate transfer belt 30 without sticking in the photoreceptor 11M is conveyed to the intermediate transfer belt cleaner 33 shown in FIG. 2 and is removed with the intermediate transfer belt cleaner 33.

As described above, according to the image forming apparatus of the exemplary embodiment, the electrically conductive foreign matter adhered on the intermediate transfer belt may be tilted relative to the photoreceptor without disturbing the development image, and inconvenience such as an image defect may be avoided.

In addition, according to the image forming apparatus of the exemplary embodiment, the cracked species of the carrier adhered on the intermediate transfer belt may be tilted relative to the photoreceptor without disturbing the development image, and inconvenience such as an image defect may avoided.

Furthermore, according to the image forming apparatus of the exemplary embodiment, the electrically conductive foreign matter and the cracked species of the carrier adhered on the photoreceptor may be tilted relative to the intermediate transfer belt without disturbing the development image, and sticking of the foreign matter into the photoreceptor may be prevented. As a result, inconvenience such as an image defect may be avoided.

Previously, an example in which the electrically conductive foreign matter is tilted using one pair of comb-shaped electrodes was explained but the electric field generating equipment referred in the invention may be an electrode other than the comb-shaped electrode.

Previously, an example in which an electric field in a direction along an axis of the photoreceptor 11M is generated by the tilting equipment 17M was explained, but the electric field generator referred in the invention may be, for example, an electric field generator which generates an electric field in a direction along a running direction of a moving body as far as it generates an electric field in a direction crossing with a direction of an electric field generated by a transferring machine.

Also in the second exemplary embodiment, it is preferable that a circumferential speed V(P/R) of the photoreceptor 11, a circumferential speed V(Belt) of the intermediate transfer belt 30, and a conveying speed V(PP) of the recording paper 40 satisfy a relationship of the equation 1 and the equation 2 or the equation 3 and the equation 4 as in the first exemplary embodiment. By satisfying a relationship of the equation 1 and the equation 2 or the equation 3 and the equation 4, generation of a flaw on a surface of the photoreceptor may be further effectively suppressed.

Third Exemplary Embodiment

Figure 6:
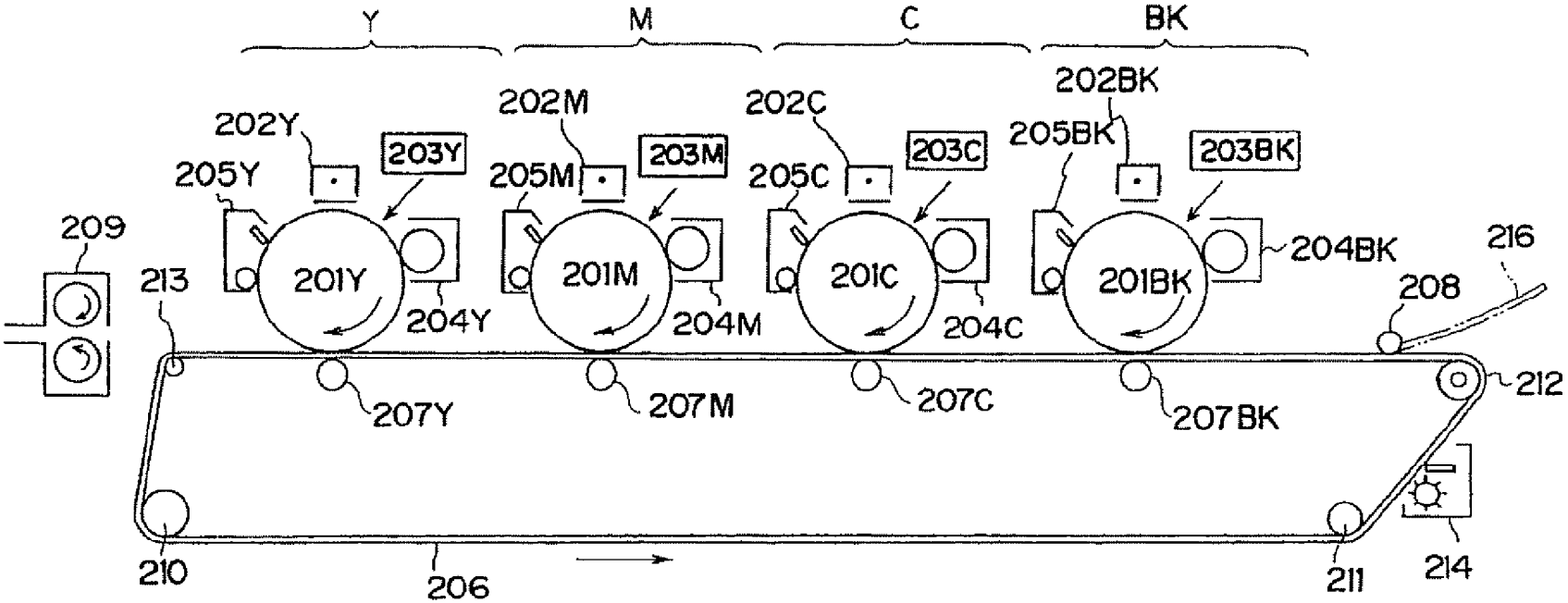
FIG. 6 is a schematic construction view showing the image forming apparatus of the invention of a third exemplary embodiment.

FIG. 6 is a schematic construction view showing the image forming apparatus of the invention related to the third exemplary embodiment. The exemplary embodiment is constructed as a paper conveying and direct transferring manner image forming apparatus equipped with a paper conveying belt.

The image forming apparatus shown in FIG. 6 is equipped with units Y, M, C, BK, the paper conveying belt (conveying belt) 206, transferring rolls (transfer unit) 207Y, 207M, 207C, 207BK, the paper conveying roll 208, and the fixing equipment (fixing unit) 209. A surface hardness of a side contacting with photoreceptor drums (image holding member) 201Y, 201M 201C, 201BK of the paper conveying belt 206 is 10 to 30.

Units Y, M, C, BK are equipped with photoreceptor drums (image holding member) 201Y, 201M, 201C, 201BK rotatably at a predetermined circumferential speed (process speed) in an arrow clockwise direction. At a periphery of photoreceptor drums 201Y, 201M, 201C, 201BK, corotron charging equipments (charging unit) 202Y, 202M, 202C, 202BK, light exposing equipments (latent image forming unit) 203Y, 203M, 203C, 203BK, respective color developing apparatuses (developing unit) (yellow developing apparatus 204Y, magenta developing apparatus 204M, cyan developing apparatus 204C, black developing apparatus 204BK1, and photoreceptor drum cleaners (cleaning unit) 205Y, 205M, 205C, 205BK are arranged, respectively. In the yellow developing apparatus 204Y, the magenta developing apparatus 204M, the cyan developing apparatus 204C and the black developing apparatus 204BK, the same two-component developer as that of the first exemplary embodiment may be used.

Although units Y, M, C, BK are arranged in an order of units Y, M, C, BK in series of four relative to the paper conveying belt 206, an order of units BK, Y, C, M may be suitably set in conformity with the image forming, method.

The paper conveying belt 206 is rotatable at the same circumferential speed as that of photoreceptor drums 201Y, 201M, 201C, 201BK in an arrow counterclock direction by belt supporting rolls 210, 211, 212, 213, and is arranged so that a part thereof positioning between belt supporting rolls 212 and 213 is contacted with photoreceptor drums 201Y, 201M, 201C, 201BK, respectively. The paper conveying belt 206 is equipped with a cleaning device 214 for a belt.

Transferring rolls 207Y, 207M, 207C, 207BK are arranged inside the paper conveying belt 206 at a position opposite to a part where the paper conveying belt 206 is contacted with photoreceptor drums 201Y, 201M, 201C, 201BK, respectively, and those rolls together with photoreceptor drums 201Y, 201M, 201C, 201BK form a transfer region (contact part) for transferring the toner image onto the paper (transfer receiving body) 216 via the paper conveyed belt 206. Transferring rolls 207Y, 207M, 207C, 207BK may be arranged beneath photoreceptor drums 201Y, 201M, 201C, 201BK as shown in FIG. 6, or may be arranged at a position shifted from beneath although not shown.

The fixing apparatus 209 is arranged so that each transfer region (contact part) of the paper conveying belt 206 and photoreceptor drums 201Y, 201M, 201C, 201BK may be conveyed after the paper 216 has passed.

By the paper conveying roll 208, the paper 216 is conveyed to the paper conveying belt 206.

In the image forming apparatus shown in FIG. 6, the photoreceptor drum 201BK is rotation-driven in the unit BK. The corotron charging equipment 202BK is driven linked with this to charge a surface of the photoreceptor drum 201BK at a predetermined polarity and potential. The photoreceptor drum 201BK whose surface has been charged is then exposed to light in an image manner with the light exposing equipment 203BK to form an electrostatic latent image on the surface thereof.

Subsequently, the electrostatic latent image is developed with the black developing apparatus 204BK. Then, a toner image is formed on a surface of the photoreceptor drum 201BK.

When this toner image passes through a transfer region (contact part) of the photoreceptor drum 201BK and the paper conveying belt 206, the paper 216 is electrostatically adsorbed onto the paper conveying belt 206 and conveyed to the transfer region (contact part), and the toner image is successively transferred onto an outer circumferential surface of the paper 216 by an electric field formed by a transfer voltage applied from the transferring roll 207BK.

Thereafter, the toner remaining on the photoreceptor drum 201BK is cleaned and removed with the photoreceptor drum cleaner 205BK. And, the photoreceptor drum 201BK is subjected to a next transfer cycle.

The above transfer cycle is also performed similarly in units C, M and Y.

The paper 216 onto which the toner image has been transferred with transferring rolls 207BK, 207C, 207M and 207Y is further conveyed to the fixing apparatus 209, followed by fixing.

As described above a desired image is formed on the recording paper.

In the exemplary embodiment, since a predetermined paper conveying belt and a developer containing a predetermined carrier are used, generation of the cracked species of the carrier in the developing equipment or between the photoreceptor and the paper conveying belt may be prevented. For this reason, sticking of the cracked species of the carrier in a surface of the photoreceptor, and generation of a flaw on a surface of the photoreceptor are suppressed, generation of breakage of a blade edge part when the cleaning blade is used as a cleaning unit is suppressed, and unevenness of adhesion of toner components to a surface of the charging equipment when a contact-type charging equipment is suppressed. Further, since sticking of the cracked species of the carrier in the paper conveying belt may be prevented, the paper conveyability and paper adhesiveness are not deteriorated. As a result, long term running stability of the paper conveying belt, and image retention become possible.

The image forming apparatus related to the third exemplary embodiment may be further equipped with an electric field generating unit for generating an electric field in a direction crossing with a direction of an electric field generated by the transferring roll, at a position aligning on an upstream side in a rotation direction of the paper conveying belt 206 relative to the photoreceptor drum. Thereby, generation of a flaw on a surface of the image holding member may be further suppressed.

EXAMPLES

The present invention will be explained in more detail below based on the following Examples, but the invention is not limited to the Examples. In the following Examples, unless otherwise is indicated, "part" means "part by mass", and "average particle diameter" means "volume average particle diameter".

(Preparation of Ferrite Core Material 1)

Seventy two parts of $FeO_3$, 18 parts of $MnO_2$, and 10 parts of LiOH are mixed, mixed/ground with a wet ball mill for 10 hours, granulated and dried with a spray dryer, and provisionally fired at 900° C. for 8 hours using a rotary kiln. The thus obtained provisional fired product is ground to an average particle diameter of 2.0 μm with a wet ball mill for 7 hours, further granulated and dried with a spray dryer, and subjected to regular firing in an electric furnace at a temperature of 1100° C. for 10 hours. Via a grinding step and a classification step, a ferrite core material 1 which is a Mn ferrite particle having an average particle diameter of 37.6 μm is prepared. A surface roughness Sm (average interval of irregularities) and a surface roughness Ra (arithmetic average roughness) of the prepared ferrite core material 1 are measured by the aforementioned method, and a surface roughness Sm is found to be 1.5 μm, and a surface roughness Ra is found to be 0.4 μm. And, an average circularity degree is measured and is found to be 0.990.

(Preparation of Ferrite Core Material 2)

Seventy three parts of $Fe_2O_3$, 23 parts of $MnO_2$, and 4 parts of $Mg(OH)_2$ are mixed, mixed/ground with a wet ball mill for 25 hours, granulated and dried with a spray dryer, and provisionally fired 1 at 800° C. for 7 hours using a rotary kiln to obtain a provisional fired 1 product. The thus obtained provisional fired 1 product is ground to an average particle diameter of 1.8 μm with a wet ball mill for 7 hours, further granulated and dried with a spray dryer, and provisionally fired 2 at 900° C. for 6 hours using a rotary kiln to obtain a provisional fired 2 product. The thus obtained provisional fired 2 product is ground to an average particle diameter of 2.3 μm with a wet ball mill for 5 hours, further granulated and dried with a spray dryer, and subjected to regular firing in an electric furnace at a temperature of 1250° C. for 10 hours. Via a grinding step and a classification step, a ferrite core material 2 which is a Mn—Mg ferrite particle having an average particle diameter of 36.2 μm is prepared. A surface roughness Sm (average interval of irregularities), and a surface roughness Ra (arithmetic average roughness) of the prepared ferrite core material 2 are measured by the aforementioned method, and a surface roughness Sm is found to be 1.7 μm, and a surface roughness Ra is found to be 0.2 μm. And, an average circularity degree is measured, and is found to be 0.986.

(Preparation of Ferrite Core Material 3)

Seventy-three parts of $Fe_2O_3$, 23 parts of $MnO_2$, and 4 parts of $Mg(OH)_2$ are mixed, mixed/ground with a wet ball mill for 10 hours, granulated and dried with a spray dryer, and provisionally fired at 900° C. for 8 hours using a rotary kiln. The thus obtained provisional fired product is ground to an average particle diameter of 2.5 μm with a wet ball mill for 7 hours, further granulated and dried with a spray dryer, and subjected to regular firing at 1300° C. for 8 hours in an electric furnace. Via a grinding step and a classification step, a ferrite core material 3 which is a Mn—Mg ferrite particle having an average particle diameter of 37.1 μm is prepared. A surface roughness Sm (average interval of irregularities) and a surface roughness Ra (arithmetic average roughness) of the prepared ferrite core material 3 are measured by the aforementioned method, and a surface roughness Sm is found to be 1.9 μm, and a surface roughness Ra is found to be 0.1 μm. And, an average circularity degree is measured, and is found to be 0.977.

(Preparation of Ferrite Core Material 4)

Seventy-three parts of $Fe_2O_3$, 23 parts of $MnO_2$, 3.5 parts of $Mg(OH)_2$, and 0.5 part of SrO are mixed, mixed/ground with a wet ball mill for 10 hours, Granulated and dried with a spray dryer, and provisionally fired at 900° C. for 8 hours using a rotary kiln. The thus obtained provisional fired product is ground to an average particle diameter of 2.0 μm with a wet ball mill for 7 hours, further granulated and dried with a spray dryer, and subjected to regular firing in an electric furnace at a temperature 950° C. for 10 hours. Via a grinding step and a classification step, a ferrite core material 4 which is a Mn—Mg ferrite particle having an average particle diameter of 36.2 μm is prepared. A surface roughness Sm (average interval of irregularities), and a surface roughness Ra (arithmetic average roughness) of the prepared ferrite core material 4 are measured by the aforementioned method, and a surface roughness Sm is found to be 1.5 μm, and a surface roughness Ra is found to be 0.6 μm. And, an average circularity degree is measured, and is found to be 0.988.

(Preparation of Ferrite Core Material 5)

Seventy five parts of $Fe_2O_3$, 15 parts of $MnO_2$, and 10 parts of LiOH are mixed, mixed/ground with a wet ball mill for 10 hours, granulated and dried with a spray dryer, and provisionally fired at 900° C. for 8 hours using a rotary kiln. The thus obtained provisional fired product is ground to an average particle diameter of 0.8 μm with a wet ball mill for 7 hours, further granulated and dried with a spray drier, and subjected to regular firing in an electric furnace at a temperature of 1300° C. for 10 hours. Via a grinding step and a classification step, a ferrite core material 5 which is a Mn—Mg ferrite particle having an average particle diameter of 36.8 μm is prepared. A surface roughness Sm (average interval of irregularities) and a surface roughness Ra (arithmetic average roughness) of the prepared ferrite core material 5 are measured by the aforementioned method, and a surface roughness Sm is found to be 0.4 μm, and a surface roughness Ra is found to be 0.1 μm. And, an average circularity degree is measured, and is found to be 0.995.

(Preparation of Ferrite Core Material 6)

Seventy three pats of $Fe_2O_3$, 23 parts of $MnO_2$, 3.5 parts of $Mg(OH)_2$, and 0.5 part of SrO are mixed, mixed/ground with a wet ball mill for 10 hours, Granulated and dried with a spray dryer, and provisionally fired at 800° C. for 8 hours using a rotary kiln. The thus obtained provisional fired product is around to an average particle diameter of 2.7 μm with a wet ball mill for 8 hours, further granulated and dried with a spray dryer, and subjected to regular firing in an electric furnace at a temperature 1100° C. for 10 hours. Via a grinding step and a classification step, and a ferrite core material 6 which is a Mn—Mg ferrite particle having an average particle diameter of 35.9 μm is prepared. A surface roughness Sm (average interval of irregularities), and a surface roughness Ra (arithmetic average roughness) of the ferrite core material 6 are measured by the aforementioned method, and a surface roughness Sm is found to be 2.1 μm, and a surface roughness Ra is found to be 0.4 μm. And, an average circularity degree is measured, and is found to be 0.970.

(Preparation of Ferrite Core Material 7)

Seventy eight parts of $Fe_2O_3$, 10 parts of $MnO_2$, and 12 parts of LiOH are mixed, mixed/ground with a wet ball mill for 10 hours, granulated and dried with a spray dryer, and provisionally fired at 900° C. for 7 hours using a rotary kiln. The thus obtained provisional fired product is ground to an average particle diameter of 2.0 μm with a wet ball mill for 8 hours, further granulated and dried with a spray dryer, and subjected to regular firing in an electric furnace at a temperature of 1350° C. for 8 hours. Via a grinding step and a classification step, a ferrite core material 7 which is a Mn—Mg ferrite particle having an average particle diameter of 37.1 μm is prepared. A surface roughness Sm (average interval of irregularities), and a surface roughness Ra (arithmetic average roughness) of the prepared ferrite core material 7 are measured by the aforementioned method, and a surface roughness Sm is found to be 1.5 μm, and a surface roughness Ra is found to be 0.08 μm. And, an average circularity degree is measured, and is found to be 0.990.

Following resins 1 to 8 are prepared. Following resins 1 to 8 are measured for an acid value by the aforementioned method.

[Resin 1]

Styrene-ethyl methacrylate-acrylic acid copolymer (copolymerization ratio (with respect to mass) 2:7.8:0.2, weight average molecular weight:100000, acid value:9 mgKOH/g)

[Resin 2]

Ethylene-methyl methacrylate-maleic anhydride copolymer (copolymerization ratio (with respect to mass) 2:7:1, weight average molecular weight:68000, acid value. 14 mgKOH/g)

[Resin 3]

Resin in which acrylpolyol is treated with tolylene diisocyanate (weight average molecular weight of acrylpolyol: 48000/, acid value:30 mgKOH/g)

[Resin 4]

Terephthalic acid-dodecenylsccinic acid-bisphenol A ethylene oxide adduct polymer (weight ratio of terephthalic acid-dodecenylsccinic acid 9:1, weight average molecular weight:23 000, acid value:16 mgKOH/cg)

[Resin 5]

Ethyl methacrylate resin (weight average molecular weight: 96000, acid value: 5 mgKOH/g)

[Resin 6]

Styrene-methyl methacrylate-methacrylic acid copolymer (copolymerization ratio (with respect to mass) 2:7.5:0.5, weight average molecular weight: 120000, acid value: 23.0 mgKOH/g)

[Resin 7]

Styrene-methyl methacrylate-methacrylic acid copolymer (copolymerization ratio (with respect to mass) 2:7.2:0.8, weight average molecular weight: 110000, acid value. 30 mgKOH/g)

[Resin 8]

Resin in which acrylpolyol is treated with xylene diisocyanate (weight average molecular weight of acrylpolyol: 41000/, acid value: 23 mgKOH/g)

| (Preparation of coating solution 1) | |
|---|---|
| Resin 1 | 30 parts |
| Toluene (Wako Pure Chemical Industries, Ltd.) | 450 parts |
| Carbon black (trade name VXC 72, manufactured by Cabot Japan K.K.) | 4 parts |

The above components and glass beads (particle diameter: 1 mm, same volume as that of toluene) are placed into a sand mill manufactured by Kansai Paint Co., LTD., and stirred at a rotation rate of 1200 rpm for 30 minutes to prepare a coating solution 1.

| (Preparation of coating solution 2) | |
|---|---|
| Resin 2 | 30 parts |
| 2-Butanone (Wako Pure Chemical Industries, Ltd.) | 450 parts |

The resin 2 is dissolved in 2-butanone at the above component ratio to prepare a coating solution 2.

| (Coating solution 3) | |
|---|---|
| Resin 3 | 30 parts |
| 2-Butanone (Wako Pure Chemical Industries, Ltd.) | 450 parts |

The resin 3 is dissolved in 2-butanone at the above component ratio to prepare a coating solution 3.

| (Coating solution 4) | |
|---|---|
| Resin 4 | 30 parts |
| 2-Butanone (Wako Pure Chemical Industries, Ltd.) | 450 parts |
| Carbon black (trade name VXC 72, manufactured by Cabot Japan K.K.) | 4 parts |

The above components and glass beads (particle diameter: 1 mm, same volume as that of toluene) are placed into a sand mill manufactured by Kansai Paint Co., LTD., and stirred at a rotation rate of 1200 rpm for 30 minutes to prepare a coating solution 4.

| (Coating solution 5) | |
|---|---|
| Resin 5 | 30 parts |
| 2-Butanone (Wako Pure Chemical Industries, Ltd.) | 450 parts |

The resin 5 is dissolved in 2-butanone at the above component ratio to prepare a coating solution 5.

| (Coating solution 6) | |
|---|---|
| Resin 6 | 30 parts |
| 2-Butanone (Wako Pure Chemical Industries, Ltd.) | 450 parts |

The resin 6 is dissolved in 2-butanone at the above component ratio to prepare a coating solution 6.

| (Coating solution 7) | |
|---|---|
| Resin 7 | 30 parts |
| 2-Butanone (Wako Pure Chemical Industries, Ltd.) | 450 parts |

The resin 7 is dissolved in 2-butanone at the above component ratio to prepare a coating solution 7.

| (Coating solution 8) | |
|---|---|
| Resin 8 | 30 parts |
| 2-Butanone (Wako Pure Chemical Industries, Ltd.) | 450 parts |

The resin 8 is dissolved in 2-butanone at the above component ratio to prepare a coating solution 8.

<Preparation of Carrier 1 and Developer 1>

Into a composite-type fluidized coating apparatus (trade name MP01-SFP, manufactured by Powrex corp.) is placed 1000 parts of a ferrite core material 1, 25 parts of the coating solution 2 is coated on a ferrite core material 1 for 24 minutes under the condition of a screen mesh of 0.5 mm, a rotation of an impeller of 1000 rpm, an exhaust air amount of 1.2 $m^3$/min, a coating rate of 10 g/min, and a temperature of 65° C. Subsequently, according to the same manner as that described above except that a temperature is 70° C., and the coating solution 2 is chanced to the coating solution 1 in the coating condition, the coating solution 1 is coated on the ferrite core material 2 on which the coating solution 2 has been coated for 43 minutes. The resulting carrier is designated as carrier 1. A total coating amount of respective resin-coated layers formed with the coating solution 1 and the coating solution 2 of the carrier 1 is 4.8% by mass.

A total coating amount of respective resin-coated layers of the carrier may be measured as follows. The carrier is weighed at 10 g, and is dipped in 100 ml of tetrahydrofuran. This is stirred for 20 minutes, and filtered with a No. 5A filter. Dissolution in tetrahydroxyfuran, and filtration is repeated total three times, and a coating amount is calculated from a difference between a weight of the carrier at an initial stage and a weight of the carrier after filtration. A cyan toner for DocuCenterColor 400 (trade name DCC 400, manufactured by Fuji Xerox Co., Ltd.), and a carrier 1 are mixed so that a mass ratio of the toner and the carrier is 6:100, to obtain a developer 1.

<Preparation of Carrier 2 and Developer 2>

According to the same manner as that of preparation of the carrier 1 except that the coating solution 2 is changed to the coating solution 3 in preparation of the carrier 1, a carrier 2 is prepared. A total coating amount of respective resin-coated layers formed with the coating solution 1 and the coating solution 3 of the resulting carrier 2 is 4.9% by mass. Further, according to the same manner as that of preparation of the developer 1 except that the carrier 1 is changed to the carrier 2, a developer 2 is prepared.

<Preparation of Carrier 3 and Developer 3>

According to the same manner as that of preparation of the carrier 1 except that the coating solution 2 is changed to the coating solution 3 in first coating, and the coating solution 1 is changed to the coating solution 4 in second coating, a carrier 3 is prepared. A total coating amount of respective resin-coated layers formed with the coating solution 3 and the coating solution 4 of the resulting carrier 3 is 5.1% by mass.

Further, according to the same manner as that of preparation of the developer 1 except that the carrier 1 is changed to the carrier 3, a developer 3 is prepared.

<Preparation of Carrier 4 and Developer 4>

According to the same manner as that of preparation of the carrier 1 except that the coating solution 2 is changed to the coating solution 8 in first coating, and the coating solution 1 is changed to the coating solution 6 in second coating, a carrier 4 is prepared. A total coating amount of respective resin-coated layers formed with the coating solution 6 and the coating solution 8 of the resulting carrier 4 is 5.0% by mass. Further, according to the same manner as that of preparation of the developer 1 except that the carrier 1 is changed to the carrier 4, a developer 4 is prepared.

<Preparation of Carrier 5 and Developer 5>

According to the same manner as that of preparation of the carrier 1 except that the coating solution 2 is changed to the coating solution 8 in first coating, and the coating solution 1 is changed to the coating solution 7 in second coating, a carrier 5 is prepared. A total coating amount of respective resin-coated layers formed with the coating solution 7 and the coating solution 8 of the resulting carrier 5 is 5.1% by mass. Further, according to the same manner as that of preparation of the developer 1 except that the carrier 1 is changed to the carrier 5, a developer 5 is prepared.

<Preparation of Carrier 6 and Developer 6>

According to the same manner as that of preparation of the carrier 1 except that the ferrite core material 1 is changed to the ferrite core material 2 in preparation of the carrier 1, a carrier 6 is prepared. A total coating amount of respective resin-coated layers formed with the coating solution 1 and the coating solution 2 of the resulting carrier 6 is 4.6% by mass. Further, according to the same manner as that of preparation of the developer 1 except that the carrier 1 is changed to the carrier 6, a developer 6 is prepared.

<Preparation of Carrier 7 and Developer 7>

According to the same manner as that of preparation of the carrier 1 except that the ferrite core material 1 is changed to the ferrite core material 3 in preparation of the carrier 1, a carrier 7 is prepared. A total coating amount of respective resin-coated layers formed with the coating solution 1 and the coating solution 2 of the resulting carrier 7 is 4.7% by mass. Further, according to the same manner as that of preparation of the developer 1 except that the carrier 1 is changed to the carrier 7, a developer 7 is prepared.

<Preparation of Carrier 8 and Developer 8>

According to the same manner as that of preparation of the carrier 1 except that the ferrite core material 1 is changed to the ferrite core material 4 in preparation of the carrier 1, a carrier 8 is prepared. A total coating amount of respective resin-coated layers formed with the coating solution 1 and the coating solution 2 of the resulting carrier 8 is 4.8% by mass. Further, according to the same manner as that of preparation of the developer 1 except that the carrier 1 is changed to the carrier 8, a developer 8 is prepared.

<Preparation of Carrier 9 and Developer 9>

According to the same manner as that of preparation of the carrier 1 except that the ferrite core material 1 is changed to the ferrite core material 5 in preparation of the carrier 1, a carrier 9 is prepared. A total coating amount of respective resin-coated layers formed with the coating solution 1 and the coating solution 2 of the resulting carrier 9 is 4.7% by mass. Further, according to the same manner as that of preparation of the developer 1 except that the carrier 1 is changed to the carrier 9, a developer 9 is prepared.

<Preparation of Carrier 10 and Developer 10>

According to the same manner as that of preparation of the carrier 1 except that the coating solution 2 is changed to the coating solution 4 in preparation of the carrier 1, a carrier 10 is prepared. A total coating amount of respective resin-coated layers formed with the coating solution 1 and the coating solution 4 of the resulting carrier 10 is 4.7% by mass. Further, according to the same manner as that of preparation of the developer 1 except that the carrier 1 is changed to the carrier 10, a developer 10 is prepared.

<Preparation of Carrier 11 and Developer 11>

According to the same manner as that of preparation of the carrier 1 except that the coating solution 2 is changed to the coating solution 5 in preparation of the carrier 1, a carrier 11 is prepared. A total coating amount of respective resin-coated layers formed with the coating solution 1 and the coating solution 5 of the resulting carrier 11 is 4.8% by mass. Further, according to the same manner as that of preparation of the developer 1 except that the carrier 1 is changed to the carrier 11, a developer 11 is prepared.

<Preparation of Carrier 12 and Developer 12>

According to the same manner as that of preparation of the carrier 1 except that the ferrite core material 1 is changed to the ferrite core material 6 in preparation of the carrier 1, a carrier 12 is prepared. A total coating amount of respective resin-coated layers formed with the coating solution 1 and the coating solution 2 of the resulting carrier 12 is 4.7% by mass. Further, according to the same manner as that of preparation of the developer 1 except that the carrier 1 is changed to the carrier 12, a developer 12 is prepared.

<Preparation of Carrier 13 and Developer 13>

According to the same manner as that of preparation of the carrier 1 except that the ferrite core material 1 is changed to the ferrite core material 7 in preparation of the carrier 1, a carrier 13 is prepared. A total coating amount of respective resin-coated layers formed with the coating solution 1 and the coating solution 2 of the resulting carrier 13 is 4.7% by mass. Further, according to the same manner as that of preparation of the developer 1 except that the carrier 1 is changed to the carrier 13, a developer 13 is prepared.

<Preparation of Carrier 14 and Developer 14>

Into a composite-type fluidized coating apparatus (trade name MP01-SFP, manufactured by Powrex corp.) is placed 1000 parts of the ferrite core material 2, the coating solution 1 is coated for 57 minutes under the condition of a screen mesh of 0.5 mm, a rotation of an impeller of 1000 rpm, an exhaust air amount of 1.2 $m^3$/min, a coating rate of 10 g/min, and a temperature of 70° C., to prepare a carrier 14. A coating amount of the resin-coated layer formed with the coating solution 1 of the resulting carrier 14 is 3.9% by mass. Further, according to the same manner as that of preparation of the developer 1 except that the carrier 1 is changed to the carrier 14, a developer 14 is prepared.

Example 1

The developer 1 is placed into an intermediate transfer manner image forming apparatus (DocuCentre Color A450 modified machine (which is modified so that a circumferential speed V(P/R) of the image holding member, a circumferential speed V(Belt) of the intermediate transfer belt, and a conveying speed V(PP) of the transfer receiving body may be changed, and is equipped with the tilting equipment shown in FIG. 2)) shown in FIG. 1, this is allowed to stand overnight under the environment of 28° C. and 90RH %, and a running test is performed to output 5000 images in a single printing mode at an image density of 8%. For outputting an image, a half tone image (toner carrying amount 0.01 mg/cm$^2$) is outputted on one A3 paper (R paper, manufactured by Fuji Xerox Co., Ltd.) every 5000 papers, and a size and the number of color spots on an image are assessed according to the following criteria. Then, one white paper is outputted and fog of the white paper is confirmed with a loupe. As a result, a color spot is A, and no fog is confirmed.

A surface hardness of a side contacting with the photoreceptor of the intermediate transfer belt disposed in the image forming apparatus used in Example 1 is 18. Rates are set as follows: V(P/R)=V(PP)<V(Belt), V(Belt)/V(P/R)=1.10. As shown as the titling equipment 17 in FIG. 3, the tilting equipment is positioned on a side opposite to the photoreceptor 11 holding the intermediate transfer belt 30, on an upstream side of the transfer position P in the circulation passageway of the intermediate transfer belt 30. As the tilting equipment, one pair of comb-shaped electrodes 171 and 172 shown in FIG. 4 are applied, and a voltage of 400V is applied between those comb-shaped electrodes 171 and 172.

[Evaluation Criteria]

A: No color spot is confirmed.

B: Ten or less of color spots having a diameter of 100 μm or less are confirmed.

C: Eleven or more color spots having a diameter of 100 μm or less are confirmed.

D: One or more color spots having a diameter of more than 100 μm are confirmed. Or, 30 or more color spots having a diameter of 100 μm or less are confirmed.

An acceptable range is up to C.

Example 2

According to the same manner as that of Example 1 except that the developer 1 is changed to the developer 2, an image surface is evaluated, and a color spot is found to be A, but slight fog is confirmed.

Example 3

According to the same manner as that of Example 1 except that the developer 1 is changed to the developer 3, an image surface is evaluated, and a color spot is found to be A, but slight fog is confirmed.

Example 4

According to the same manner as that of Example 1 except that the developer 1 is changed to the developer 4, an image surface is evaluated, and a color spot is found to be A, but extremely slight fog is confirmed.

Example 5

According to the same manner as that of Example 1 except that the developer 1 is changed to the developer 5, an image surface is evaluated, and a color spot is found to be A, and no fog is confirmed.

Example 6

According to the same manner as that of Example 1 except that the developer 1 is changed to the developer 6, an image surface is evaluated, and a color spot is found to be B, and no fog is confirmed.

Example 7

According to the same manner as that of Example 1 except that the developer 1 is changed to the developer 7, an image surface is evaluated, and a color spot is found to be B, and no fog is confirmed.

Example 8

According to the same manner as that of Example 1 except that the developer is changed to the developer 8, an image surface is evaluated, and a color spot is found to be C, and no fog is confirmed.

Example 9

According to the same manner as that of Example 1 except that the developer 1 is chanced to the developer 9, an image surface is evaluated, and a color spot is found to be C, and no fog is confirmed.

Example 10

According to the same manner as that of Example 1 except that the developer 1 is changed to the developer 10, an image surface is evaluated, and a color spot is found to be A, and no fog is confirmed.

Example 11

According to the same manner as that of Example 1 except that the developer 1 is chanced to the developer 11, an image surface is evaluated, and a color spot is found to be A, and no fog is confirmed.

Comparative Example 1

According to the same manner as that of Example 1 except that the developer 1 is changed to the developer 12, an image surface is evaluated and a color spot is found to be D.

Comparative Example 2

According to the same manner as that of Example 1 except that the developer 1 is changed to the developer 13, an image surface is evaluated and a color spot is found to be D.

Comparative Example 3

According to the same manner as that of Example 1 except that the developer 1 is changed to the developer 14, an image surface is evaluated and a color spot is found to be D.

Example 12

Using the developer 1, and according to the same manner as that of Example 1 except that rates are set as follows: V(P/R)≈V(PP)<V(Belt), and V(Belt)/V(P/R)=1.05, an image surface is evaluated, a color spot is found to be A, and no fog is confirmed.

Example 13

Using the developer 1, and according to the same manner as that of Example 1 except that rates are set as follows:

V(P/R)≈V(PP)<V(Belt), and V(Belt)/V(P/R)=1.15, an image surface is evaluated, a color spot is found to be A, and no fog is confirmed.

Example 14

Using the developer 1, and according to the same manner as that of Example 1 except that rates are set as follows: V(P/R)≈V(PP)≈V(Belt), and V(Belt)/V(P/R)=1.00, an image surface is evaluated, a color spot is found to be C, and no fog is confirmed.

Example 15

Using the developer 1, and according to the same manner as that of Example 1 except that rates are set as follows: V(P/R)≈V(PP)<V(Belt), and V(Belt)/V(P/R)=1.2, an image surface is evaluated, a color spot is found to be B, and no fog is confirmed.

Example 16

Using the developer 1, and according to the same manner as that of Example 1 except that the tilting equipment shown in FIG. 2 is not equipped, an image surface is evaluated, a color spot is found to be B, and no fog is confirmed.

Comparative Example 4

According to the same manner as that of Example 1 except that a surface hardness of a side contacting with the photoreceptor of the intermediate transfer belt is 8, an image surface is evaluated, a color spot is found to be D and, particularly, the number of less than 100 μm is large.

Comparative Example 5

According to the same manner as that of Example 1 except that a surface hardness of a side contacting with the photoreceptor of the intermediate transfer belt is 35, an image surface is evaluated, and a color spot is found to be D.

What is claimed is:

1. An image forming apparatus comprising at least an image holding member: a charging unit for charging the image holding member; a latent image forming unit for forming a latent image on a surface of the charged image holding member; a developing unit for developing the latent image formed on the surface of the image holding member with a developer containing at least a toner and a carrier to form a toner image; an intermediate transfer belt which contacts the image holding member and to which the toner image formed on the surface of the image holding member is primarily transferred; a primary transfer unit for primarily transferring the toner image formed on the surface of the image holding member onto the intermediate transfer belt by generating an electric field; a secondary transfer unit for secondarily transferring the toner image which has been primarily transferred onto the intermediate transfer belt, onto a transfer receiving body; a fixing unit for fixing the toner image which has been transferred onto the transfer receiving body; an electric field generating unit for generating an electric field in a direction crossing a direction of an electric field generated by the primary transfer unit at a position aligning on an upstream side in a rotation direction of the intermediate transfer belt relative to the image holding member; and a cleaning unit for removing residual toner on the surface of the image holding member after transfer, a surface hardness of a side, of the intermediate transfer belt, contacting with the image holding member being 10 to 30, the surface hardness being a durometer hardness according to JIS K7215, the carrier having at least two resin-coated layers on a surface of a core material containing ferrite, and the core material having a surface roughness Sm (average interval of irregularities) of 2.0 μm or less, a surface roughness Ra (arithmetic average roughness) of 0.1 μm or more, and an average circularity degree of 0.975 to 1.000.

2. The image forming apparatus of claim 1, wherein when a circumferential speed of the image holding member is V(P/R), a circumferential speed of the intermediate transfer belt is V(Belt), and a conveying speed of the transfer receiving body is V(PP), V(P/R), V(Belt) and V(PP) satisfy the relationships of the following equation 1 and equation 2:

$$V(P/R)\approx V(PP)<V(\text{Belt}) \quad \text{Equation 1}$$

$$V(\text{Belt})/V(P/R)=1.05 \text{ to } 1.15 \quad \text{Equation 2.}$$

3. The image forming apparatus of claim 1, wherein when a circumferential speed of the image holding member is V(P/R), a circumferential speed of the intermediate transfer belt is V(Belt), and a conveying speed of the transfer receiving body is V(PP), V(P/R), V(Belt) and V(PP) satisfy the relationships of the following equation 3 and equation 4, and the toner image is formed with a ratio of the circumferential speed of the image holding member to the circumferential speed of the intermediate transfer belt V(P/R)/V(Belt) relative to a rotation direction of the image holding member on a surface of the image holding member;

$$V(P/R)<V(PP)\approx V(\text{Belt}) \quad \text{Equation 3}$$

$$V(Belt)N(P/R)=1.05 \text{ to } 1.15 \quad \text{Equation 4.}$$

4. The image forming apparatus of claim 1, wherein the intermediate transfer belt comprises a polyimide resin or a polyamideimide resin.

5. The image forming apparatus of claim 1, wherein a surface resistivity of the intermediate transfer belt is $1\times10^{9}\Omega/\square$ to $1\times10^{14}\Omega/\square$.

6. The image forming apparatus of claim 1, wherein the intermediate transfer belt comprises an electrically conductive filler.

7. The image forming apparatus of claim 1, wherein a difference between an acid value of a resin which is a main component of the at least two resin-coated layers constituting the core material surface of the carrier, and an acid value of a resin which is a main component of a resin-coated layer adjacent to the at least two resin-coated layers is 0.2 mgKOH/g to 8.0 mgKOH/g as expressed by an absolute value.

8. The image forming apparatus of claim 1, wherein the at least two resin-coated layers comprise dispersed resin particles.

9. The image forming apparatus of claim 8, wherein a content of the resin particles is 1% by volume to 50% by volume in the at least two resin-coated layers.

10. The image forming apparatus of claim 1, wherein the at least two resin-coated layers comprise dispersed electrically conductive particles.

11. The image forming apparatus of claim 10, wherein a volume electric resistance of the electrically conductive particles is $10^{1}$ Ω·cm to $10^{11}$ Ω·cm.

12. The image forming apparatus of claim 1, wherein a total coating amount of the at least two resin-coated layers is 1.0% by mass to 3.0% by mass with respect to the carrier.

13. The image forming apparatus of claim 1, wherein an average thickness of the at least two resin-coated layers is 0.1 μm to 10 μm.

14. An image forming apparatus comprising at least an image holding member; a charging unit for charging the image holding member; a latent image forming unit for forming a latent image on a surface of the charged image holding member; a developing unit for developing the latent image formed on the surface of the image holding member with a developer containing at least a toner and a carrier to form a toner image; a transfer unit for transferring the toner image formed on the surface of the image holding member onto a transfer receiving body by generating an electric field; a conveying belt which contacts the image holding member and conveys the transfer receiving body onto which the toner image is transferred; a fixing unit for fixing the toner image which has been transferred onto the transfer receiving body; an electric field generating unit for generating an electric field in a direction crossing a direction of an electric field generated by the transfer unit at a position aligning on an upstream side in a rotation direction of the conveying belt relative to the image holding member; and a cleaning unit for removing residual toner on the surface of the image holding member after transfer, a surface hardness on a side, of the conveying belt, contacting with the image holding member being 10 to 30, the surface hardness being a durometer hardness according to JIS K7215, the carrier having at least two resin-coated layers on a surface of a core material containing ferrite, and the core material having a surface roughness Sm (average interval of irregularities) of 2.0 μm or less, a surface roughness Ra (arithmetic average roughness) of 0.1 μm or more, and an average circularity degree of 0.975 to 1.000.

15. The image forming apparatus of claim 14, wherein a difference between an acid value of a resin which is a main component of the at least two resin-coated layers constituting the core material surface of the carrier, and an acid value of a resin which is a main component of a resin-coated layer adjacent to the at least two resin-coated layers is 0.2 mgKOH/g to 8.0 mgKOH/g as expressed by an absolute value.

16. The image forming apparatus of claim 14, wherein the at least two resin-coated layers comprise dispersed resin particles in an amount of 1% by volume to 50% by volume.

17. The image forming apparatus of claim 14, wherein the at least two resin-coated layers comprise dispersed electrically conductive particles.

18. The image forming apparatus of claim 17, wherein a volume electric resistance of the electrically conductive particles is $10^1$ Ω·cm to $10^1$ Ω·cm.

19. The image forming apparatus of claim 14, wherein a total coating amount of the at least two resin-coated layers is 1.0% by mass to 3.0% by mass with respect to the carrier.

20. The image forming apparatus of claim 14, wherein an average thickness of the at least two resin-coated layers is 0.1 μm to 10 μm.

* * * * *